US005175386A

United States Patent [19]

Kuwahara

[11] Patent Number: 5,175,386

[45] Date of Patent: Dec. 29, 1992

[54] KEYBOARD INSTRUMENT WITH KEYBOARD COVER MECHANISM

[75] Inventor: Shigetoshi Kuwahara, Shizuoka, Japan

[73] Assignee: Yamaha Corporation, Hamamatsu, Japan

[21] Appl. No.: 671,969

[22] Filed: Mar. 19, 1991

[30] Foreign Application Priority Data

| | | | |
|---|---|---|---|
| Mar. 20, 1990 | [JP] | Japan | 2-28991[U] |
| Mar. 20, 1990 | [JP] | Japan | 2-70814 |
| Mar. 20, 1990 | [JP] | Japan | 2-70815 |
| Nov. 30, 1990 | [JP] | Japan | 2-130362[U] |

[51] Int. Cl.[5] ..... G10C 3/02

[52] U.S. Cl. ..... 84/179; 84/DIG. 17; 312/293.2

[58] Field of Search ..... 84/177, 178, 179, DIG. 17; 312/196, 235.9, 293.2

[56] References Cited

U.S. PATENT DOCUMENTS

| | | | |
|---|---|---|---|
| 545,926 | 9/1895 | Waldecker | 84/178 |
| 690,125 | 12/1901 | Vollmar | 84/179 |
| 1,715,280 | 5/1929 | Cheek | 84/179 |
| 2,178,565 | 11/1939 | Day | 84/179 |
| 2,218,949 | 10/1940 | Day | 84/179 |
| 2,481,103 | 9/1949 | Fuller | 84/179 |
| 4,742,749 | 5/1988 | Kira et al. | 84/179 |

FOREIGN PATENT DOCUMENTS 62-46219 12/1987 Japan .

*Primary Examiner*—Cassandra C. Spyrou
*Attorney, Agent, or Firm*—Burns, Doane, Swecker & Mathis

[57] ABSTRACT

A keyboard instrument includes an instrument main body, a keyboard cover, a link member, a guide abutment portion, and a guide member. The instrument main body has a keyboard portion arranged thereon. The keyboard cover pivots about a portion near a rear end thereof to open/cover the keyboard portion on the instrument main body. The link member has one end pivotally supported on the instrument main body, and the other end pivotally supported on a portion near the rear end portion of the keyboard cover. The guide abutment portion is arranged at a position separated from the position, at which the other end of the link member is pivotally supported, in a direction of a rear surface of the instrument main body by a predetermined distance. The guide member is fixed in the instrument main body so as to cause the guide abutment portion to be moved in contact with the guide member upon opening/closing of the keyboard cover.

22 Claims, 24 Drawing Sheets

| | |
|---|---|
| L1 | 197 |
| F1 | −2 |
| T1 | −2×197=−394 |
| L2 | 41. 4 |
| F2 | 0.6×(218−36)／22.7=4.81 |
| T2 | 4. 81×41. 4=199 |
| T3 | T3=−(T1+T2) |
| | −(−394+199)=+195 |

FIG.20

| | |
|---|---|
| L1 | 201. 1 |
| F1 | −2 |
| T1 | −2×201=−402 |
| L2 | 65. 2 |
| F2 | 0.6×(179−36)／18.1=4.74 |
| T2 | 4. 74×65. 2=309 |
| T3 | T3=−(T1+T2) |
| | −(−402+309)=+93 |

FIG.21

| | |
|---|---|
| L1 | 186. 1 |
| F1 | −2 |
| T1 | −2×186. 1=−372. 2 |
| L2 | 75. 4 |
| F2 | 0.6×(113−36)／30.3=1.52 |
| T2 | 1. 52×75. 4=114. 6 |
| T3 | T3=−(T1+T2) |
| | −(−372.2+114.6)=+257.6 |

FIG.22

| | |
|---|---|
| L1 | 127. 6 |
| F1 | −2 |
| T1 | −2×127. 6=−255. 2 |
| L2 | 69. 1 |
| F2 | 0.6×(86−36)／42.9=0.7 |
| T2 | 0. 7×69. 1=48. 4 |
| F3 | F3=−(T1+T2)／L3 |
| | −(−255.2+48.4)／52.7=3.92 |
| L4 | 1. 48 |
| F4 | 4. 38 |
| T4 | 1. 48×4. 38=6. 48 |
| L5 | 20. 4 |
| F5 | 1.54×(82.5−95)／46.8=−0.4 |
| T5 | −0. 4×20. 4=−8. 16 |
| T | T=T4+T5 |
| | 6. 48−8. 16=−1. 68 |

FIG.23

| | |
|---|---|
| L1 | 56. 7 |
| F1 | −2 |
| T1 | −2×56. 7=−113. 4 |
| L2 | 70. 07 |
| F2 | 0.6×(89.7−36)/41.1=0.8 |
| T2 | 0. 8×70. 07=56. 1 |
| F3 | T1+T2+T3=0 |
| | F3=−(T1+T2)/L3 |
| | −(−113.4+56.1)/54.36=1.05 |
| L4 | 85. 9 |
| F4 | 2. 02 |
| T4 | 85. 9×2. 02=173. 5 |
| F5 | 1.54×(95−62.4)/31.1=1.6 |
| T5 | −1. 6×37. 1=−59. 4 |
| T | T=T4+T5 |
| | 173. 5−59. 4=−114. 1 |

FIG.24

| | |
|---|---|
| L1 | 8. 2 |
| F1 | 2 |
| T1 | 8. 2×2=16. 4 |
| L2 | 73 |
| F2 | 0.6×(102.5−36)/34.05=1.17 |
| T2 | 1. 17×73=85. 41 |
| F3 | T1+T2+T3=0 |
| | F3=−(T1+T2)/L3 |
| | −(−16.4+85.41)/53.47=−1.9 |
| L4 | 80. 11 |
| F4 | 2. 9 |
| T4 | 80. 11×2. 9=232. 29 |
| F5 | 1.54×(95−29)/26.01=3.9 |
| T5 | −3. 9×25. 98=−101. 3 |
| T | T=T4+T5 |
| | 232.29−101.3=130.99 |

FIG.25

| | |
|---|---|
| L1 | 62. 22 |
| F1 | 2 |
| T1 | 62. 22×2=124. 44 |
| L2 | 77. 11 |
| F2 | 0.6×(125.7−36)/26.16=2.06 |
| T2 | 2. 06×77. 11=158. 8 |
| F3 | T1+T2+T3=0 |
| | F3=−(T1+T2)/L3 |
| | −(124.44+158.8)/51.19=−5.53 |
| L4 | 35. 37 |
| F4 | 5. 46 |
| T4 | 35. 37×5. 46=193. 1 |
| F5 | 1.54×(95−16.7)/37.32=3.23 |
| T5 | −3. 23×3. 86=−12. 47 |
| T | T=T4+T5 |
| | 193. 1−12. 47=180. 63 |

FIG.26

| | |
|---|---|
| L1 | 89. 2 |
| F1 | 2 |
| T1 | 89. 2×2=178. 4 |
| L2 | 76 |
| F2 | 0. 6×(150−36)／21=3. 3 |
| T2 | 3. 3×76=250. 8 |
| F3 | T1+T2+T3=0 |
| | F3=−(T1+T2)／L3 |
| | −(−178.4+250.8)／52=−8.25 |
| L4 | 0. 95 |
| F4 | 7. 26 |
| T4 | 0. 95×−7. 26=−6. 9 |
| F5 | 1.54×(95−17)／47=2.56 |
| T5 | 2. 56×6=15. 36 |
| T | T=T4+T5 |
| | −6. 9+15. 36=8. 46 |

FIG.27

T1=F1×L1 (ROTATIONAL MOMENT ABOUT POINT A)
T2=F2×L2 (ROTATIONAL MOMENT ABOUT POINT A)
T3=F3×L3 (ROTATIONAL MOMENT ABOUT POINT A)
T4=F4×L4 (ROTATIONAL MOMENT ABOUT POINT B)
T5=F5×L5 (ROTATIONAL MOMENT ABOUT POINT B)
T=T4×T5 (ROTATIONAL MOMENT ABOUT POINT B)

KEYBOARD INSTRUMENT WITH KEYBOARD COVER MECHANISM

BACKGROUND OF THE INVENTION

1. Field of the Invention

The present invention relates to an electronic musical instrument, such as an electronic organ or an electronic piano, having an opening/closing mechanism for a keyboard cover which closes/opens a keyboard portion.

2. Description of Related Art

An electronic musical instrument having a keyboard, e.g., an electronic organ, generally includes a keyboard cover which covers and protects a keyboard portion while the instrument is not used.

Two types of keyboard covers are used: a sliding cover which is arranged to be slidable back and forth on the main body of a musical instrument (instrument main body) and is stored in the instrument main body when it is open; and a pivot cover which is arranged to be vertically pivotal and is erected on an instrument main body when it is open.

Since the sliding cover is formed like a folding shutter by coupling a large number of cover constituent members so as to be flexible, its structure becomes complicated, and a large number of components are required, resulting in a high manufacturing cost.

In contrast to this, since the pivot cover is constituted by one plate-like cover member, it can be manufactured at a low cost. In addition, since the pivot cover is erected on the instrument main body when it is open, no storage space for the cover is required in the instrument main body.

In the latter case, however, if a musical instrument has two or more upper and lower keyboards, the depth and weight of a keyboard cover are increased. For this reason, an opening/closing operation of the cover becomes less easy. In addition, the cover may abruptly fall to clamp the hands of a player due to a shift in the center of gravity of the cover when it is opened/closed.

In order to solve such a problem, for example, Japanese Utility Model Publication No. 62-46219 discloses a keyboard instrument in which when a keyboard cover is closed, a pivoting force based on the weight of the cover is damped by a damper mechanism using a spring at a latter stage of the pivoting movement of the cover.

A keyboard cover having such a mechanism, however, is increased in area with an increase in depth. For this reason, when the cover is opened and erected on an instrument main body, a player inevitably feels a sense of oppression.

In order to solve such a problem in a pivot keyboard cover, the present applicant has developed a keyboard instrument, as disclosed in Japanese Patent Laid-Open No. 63-11995, in which the pivot point of a keyboard cover is set at a position separated forward and downward from the rear end by a predetermined distance so that when the cover is opened, its rear end portion is inserted from an opening formed in the upper surface of an instrument main body to be stored therein.

An example of such a mechanism will be briefly described below with reference to FIG. 9. A pivot keyboard cover 3 is provided above a keyboard portion 2 arranged on a front portion of an instrument main body 1. First and second links 5*a* and 5*b* constituting a four-joint rotating link 5 are pivotally supported between a triangular support member 4 fixed to a rear end portion of the cover 3 and a fixed portion as a pivot point in the instrument main body 1 by using pins 6*a*, 6*b*, 7*a*, and 7*b*.

When a front end portion of this keyboard cover 3 is raised to cause the cover 3 to pivot from a position indicated by solid lines, at which the cover 3 is closed, in a direction indicated by an arrow P, the rear end of the cover is moved along a path indicated by an alternate long and dashed line L. As a result, a rear portion of the keyboard cover 3 is stored in the instrument main body 1, resulting in an cover open state indicated by imaginary lines.

According to this keyboard opening/closing mechanism, since a torque based on the weight of the keyboard cover 3 acts in opposite directions before and after the pivot point, the cover 3 can be lightly opened and closed by overbalancing it.

In addition, since the rear portion of the keyboard cover 3 is stored in the instrument main body 1 when it is open, a sense of oppression to a player can be reduced.

In such a conventional keyboard cover opening/closing mechanism, however, since the four-joint rotating link is used to pivot the keyboard cover 3, the degree of freedom of a path for pivoting movement is low, and the cover 3 is moved in the manner shown in FIG. 10A. During this pivoting movement, a large gap S is formed between the keyboard cover 3 and the front end (point A) of a top board (upper surface plate) 1*a* of the instrument main body 1, and an object may fall inside the instrument main body 1.

For this reason, a large dust cover 8 must be arranged, as shown in FIG. 9. Alternatively, a portion of the top board 1*a* must be hinged to a back board 1*b* to be pivotal in a direction indicated by an arrow Q so that an upper portion of the instrument main body 1 can be opened, thus allowing easy removable of an object therefrom.

In addition, the use of the four-joint link requires a large space for the pivoting movement of the rear portion of the keyboard cover 3 in the instrument main body 1, as shown in FIG. 9. This inevitably leads to a great reduction in mounting space for other components, e.g., a transformer 9 shown in FIG. 10A.

In any of such conventional keyboard cover opening/closing mechanisms, the safety in closing the keyboard cover is mainly considered, but damping of a shock in opening the cover is not much considered.

For this reason, since a required operating force considerably varies throughout the opening/closing process of the keyboard cover, a smooth opening/closing operation cannot necessarily be performed.

Furthermore, a gap is formed between the keyboard cover and the front end of the top board of the instrument main body upon opening/closing of the cover, and a musical score, a piece of paper, a clip, or the like may fall from the gap. As a result, a necessary thing is lost, or a mechanism or a circuit in the instrument main body may be broken down due to the object which has fallen inside the instrument main body.

In order to eliminate such inconvenience, a large dust cover must be arranged under the keyboard cover opening/closing mechanism, or a portion of the top board must be pivotally hinged to the back board to be pivoted to open the upper portion of the instrument main body, thus allowing removal of an object which has fallen inside the instrument main body. Such an arrangement increases the cost. In addition, an object which has fallen inside the instrument main body cannot be removed unless a user notices it.

Moreover, if a sufficient spring constant as a damper is provided to a spring for a damper mechanism, as a safety means, for damping a pivoting force based on the weight of a keyboard cover, the pivoting force based on the weight of the cover upon closing balances the damping force of the spring. As a result, the cover floats from the keyboard portion, and a feeling that the cover is reliably closed and the stability of the cover are impaired.

SUMMARY OF THE INVENTION

It is a principal object of the present invention to provide a keyboard instrument which reduces a sense of oppression given to a player by a keyboard cover when the cover is to be opened.

It is another object of the present invention to provide a keyboard instrument which allows free design of the path of a keyboard cover.

It is still another object of the present invention to provide a keyboard instrument in which the gap between a keyboard cover and an instrument main body is reduced to prevent the hands of a player from being caught in the gap upon opening/closing of the cover.

It is still another object of the present invention to provide a keyboard instrument in which a keyboard cover can be opened/closed with a uniform, small operating force throughout the opening/closing process of the cover.

It is still another object of the present invention to provide a keyboard instrument in which a keyboard cover can be smoothly and safely opened/closed.

It is still another object of the present invention to provide a keyboard instrument in which a storage space for components can be easily ensured.

It is still another object of the present invention to provide a keyboard instrument which can prevent a foreign object from falling inside an instrument main body through a gap upon opening/closing of a keyboard cover and from causing a failure without using a large dust cover or forming a detachable or openable portion of a top board, thus realizing a reduction in cost accordingly, as compared with a conventional keyboard instrument.

In order to achieve the above objects, according to the present invention, there is provided a keyboard instrument comprising an instrument main body having a keyboard portion arranged thereon, a keyboard cover which pivots about a portion near a rear end thereof to open/cover the keyboard portion on the instrument main body, a link member having one end pivotally supported on the instrument main body, and the other end pivotally supported on a portion near the rear end portion of the keyboard cover, a guide abutment portion arranged at a position separated from the position, at which the other end of the link member is pivotally supported, in a direction of a rear surface of the instrument main body by a predetermined distance, and a guide member, fixed in the instrument main body, for causing the guide abutment portion to be moved in contact with the guide member upon opening/closing of the keyboard cover.

BRIEF DESCRIPTION OF THE DRAWINGS

FIGS. 20 to 27 are views for explaining various values in the states shown in FIGS. 12 to 19, respectively.

DESCRIPTION OF THE PREFERRED EMBODIMENTS

An embodiment of the present invention will be described below with reference to FIGS. 1 to 6.

Figure 1:
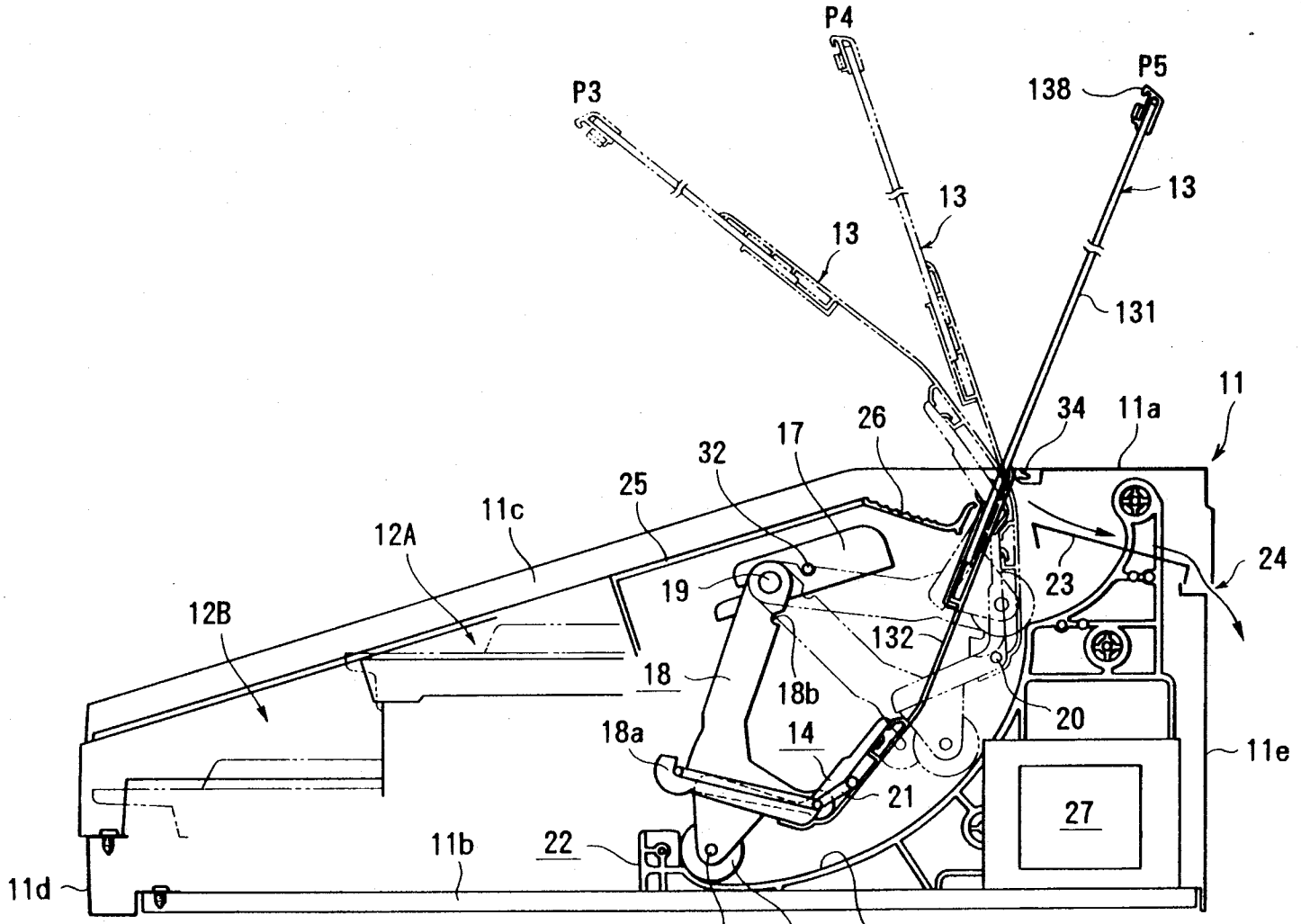
FIGS. 1 and 2 are side views showing the interior of a keyboard instrument, according to an embodiment of the present invention, except for portions which are not required for the description of a keyboard cover opening/closing mechanism.
Figure 2:
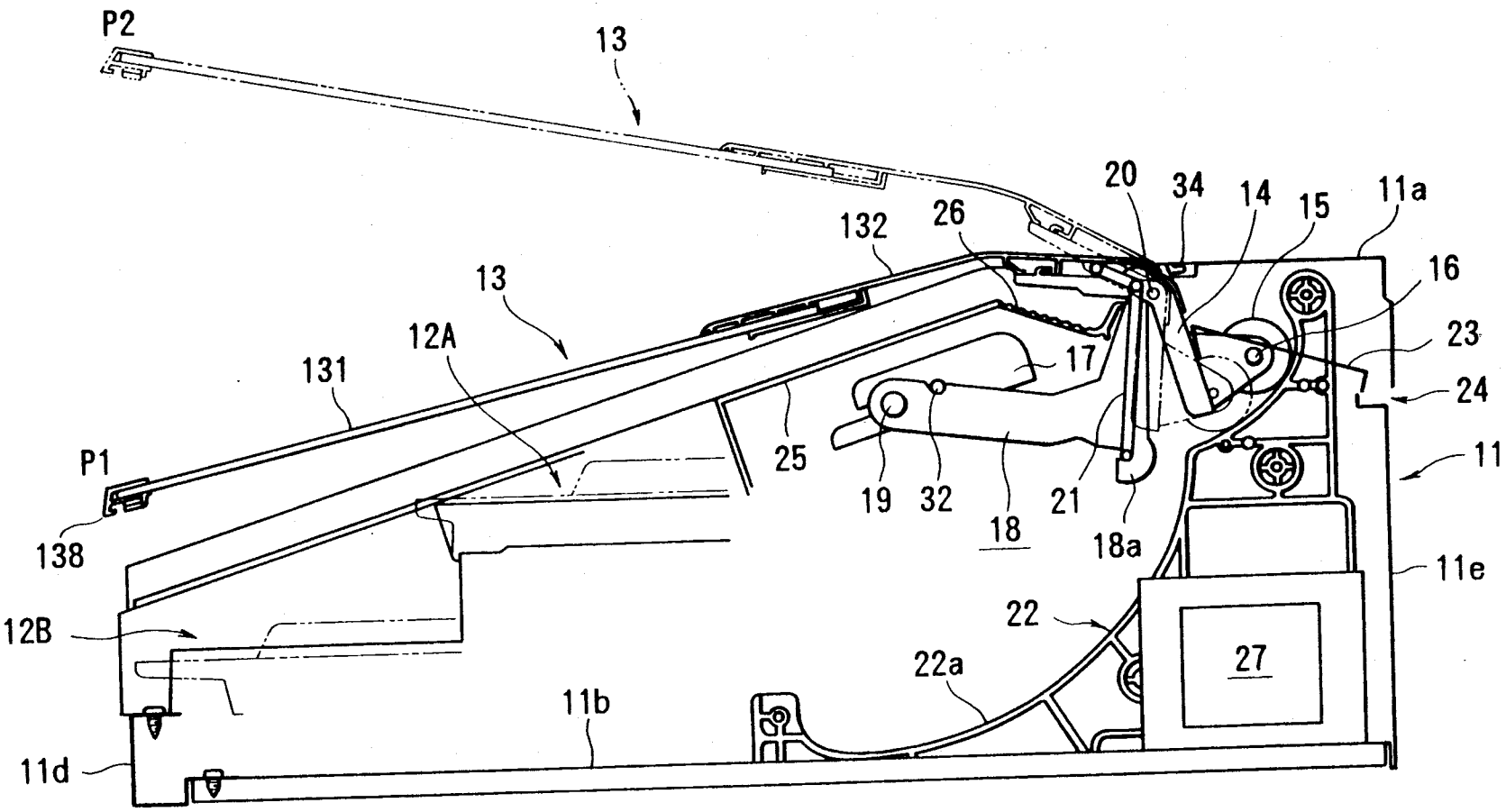

FIGS. 1 and 2 show the interior of a keyboard instrument, according to an embodiment of the present invention, except for portions which are not required for the description of a keyboard cover opening/closing mechanism.

In FIG. 2, solid lines indicate a state wherein the keyboard cover begins to open, whereas imaginary lines indicate a state wherein the cover is raised to a level slightly higher than the horizontal level. In FIG. 1, solid lines indicate a state wherein the keyboard cover is completely open, whereas imaginary lines indicate two different positions of the cover before it is completely open.

In an electronic musical instrument of this embodiment, a keyboard cover 13 is supported on an instrument main body 11 to be freely opened/closed. While the instrument is not used, the keyboard cover 13 is closed to cover and protect upper and lower keyboards 12A and 12B.

A keyboard cover opening/closing mechanism shown in FIGS. 1 and 2 is arranged on two side portions in the instrument main body 11.

A doglegged arm member 14 is fixed to a rear end portion of the keyboard cover 13. A roller 15 as a guide abutment member is rotatably attached to the arm member 14 with a shaft 16.

A bracket 17 is fixed in the instrument main body 11. One end of an L-shaped lever 18 is pivotally supported on the bracket 17 with a shaft 19. The other end of the lever 19 is pivotally supported on a middle portion of the doglegged arm member 14 with a shaft 20.

In addition, a bar receiving portion 18*a* extends outward from an intermediate portion (bent portion) of the lever 18. A torsion bar 21 is locked to a portion between the bar receiving portion 18*a* and a rear end portion of the keyboard cover 13.

A roller guide 22 as a guide member is fixed on a shelf board 11*b* of the instrument main body 11 so as to form a guide rail surface 22*a* for guiding the roller 15.

Reference numeral 11*a* denotes a top board of the instrument main body 11; 11*c*, a side board; 11*d*, a keyslip; and 11*e*, a back board.

A gap 24 is defined between the lower edge of the top board 11*a* and the upper edge of the back board 11*e*. A foreign object removable panel 23 is provided inside the gap 24 to form an inclined surface descending from a position near the path of the rear end of the keyboard cover 13 toward the back board 11*e*.

Reference numeral 25 denotes an operation panel having various types of key switches arranged thereon; and 26, a musical stand. In addition, a transformer 27 is mounted on a rear portion of the shelf board 11*b* in the instrument main body 11.

An arrangement of the keyboard cover 13 and a main part of its opening/closing mechanism in this embodiment will be described below with reference to FIGS. 3 to 5.

Figure 3:
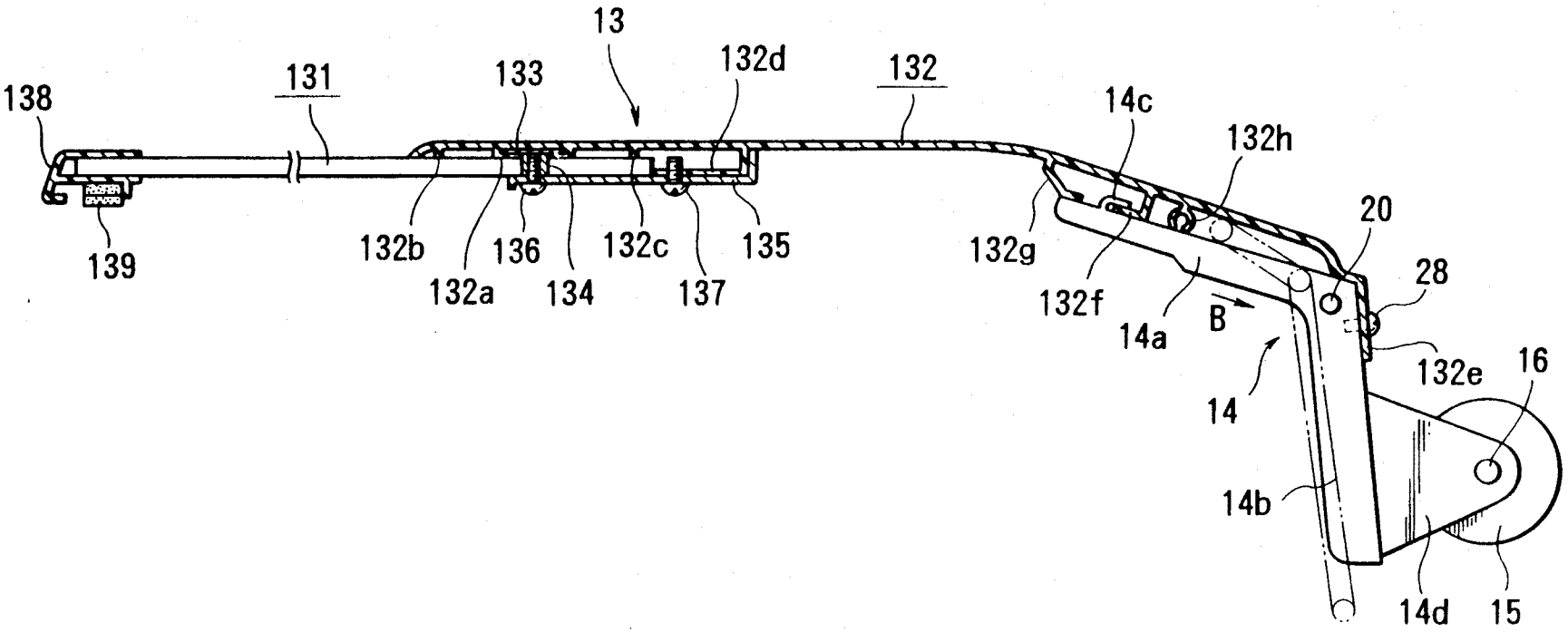
FIG. 3 is a cross-sectional view showing an arrangement of the keyboard cover.

As clearly shown in FIG. 3, the keyboard cover 13 comprises a first cover member (cover portion) 131, as the front half portion of the cover, consisting of a transparent resin, e.g., an acrylic resin, and a second cover member (portion to be stored), as the rear half portion of the cover, consisting of a metal, e.g., aluminum.

A channel-like band plate holding member 132*a*, two press projections 132*b* and 132*c*, and an L-shaped lock piece 132*d* for restricting the position of the rear end of the first cover member 131 are integrally formed along the longitudinal direction (key arrangement direction) at a joint portion, of the second cover member 132, which is jointed to the first cover member 131.

A band plate 133 is inserted into the band plate holding member 132*a* to be held. Cylindrical screw receiving members 134 (having female threads formed therein) are fixed to the band plate 133, by caulking or the like, at intervals in the longitudinal direction. The screw receiving portions 134 are fitted in through holes formed near the rear end of the first cover member 131 in such a manner that the upper surface of the member 131 is brought into contact with the projections 132*b* and 132*c* while its rear end face is brought into contact with the L-shaped lock piece 132*d*.

In addition, an L-shaped lock piece 135 is urged against the rear end portion of the first cover member 131 and the L-shaped lock piece 132*d* throughout the total length thereof, and is fixed to the screw receiving member 134 with set screws 136 and to the L-shaped lock piece 132*d* with set screws 137.

With this arrangement, set screws and the like are not exposed on the upper surface of the keyboard cover 13 while the first and second cover members 131 and 132 are firmly connected to each other.

Furthermore, a finger hook member 138 and a cushion member 139, both consisting of a resin, are attached to the front edge portion of the first cover member 131.

A bent portion 132*e* is formed at a rear end portion of the second cover member 132. An L-shaped lock portion 132*f* is formed before the bent portion 132*e*, while abutment portions 132*g* and 132*h* also serving as reinforcing portions are formed on both sides of the lock portion 132*f*. As also shown in FIG. 4, the doglegged arm member 14 is locked between the bent portion 132*e* and the lock portion 132*f*.

More specifically, a pawl portion 14*c* formed portion 14*a* of the doglegged arm member 14 is hooked on the lock portion 132*f*, and a set screw 28 inserted in a screw hole formed in the bent portion 132*e* is firmly screwed into a tap hole in the other arm portion 14*b* of the arm member 14, thereby pulling the arm member 14 in a direction indicated by an arrow B and firmly fixing it.

A pair of roller support pieces 14*d* are fixed to the lower surface of the arm portion 14*b* of the doglegged arm member 14. The two ends of the shaft 16 for rotatably supporting the roller 15 are held on the roller support pieces 14*d*.

This roller 15 is moved in rolling contact with the guide rail surface 22*a* of the roller guide 22.

The roller guide 22 is integrally formed by a synthetic resin. In practice, the roller guide is formed into a hollow structure shown in FIG. 2 to save the material and prevent molding sink, although simply shown as a block in FIG. 4.

Figure 4:
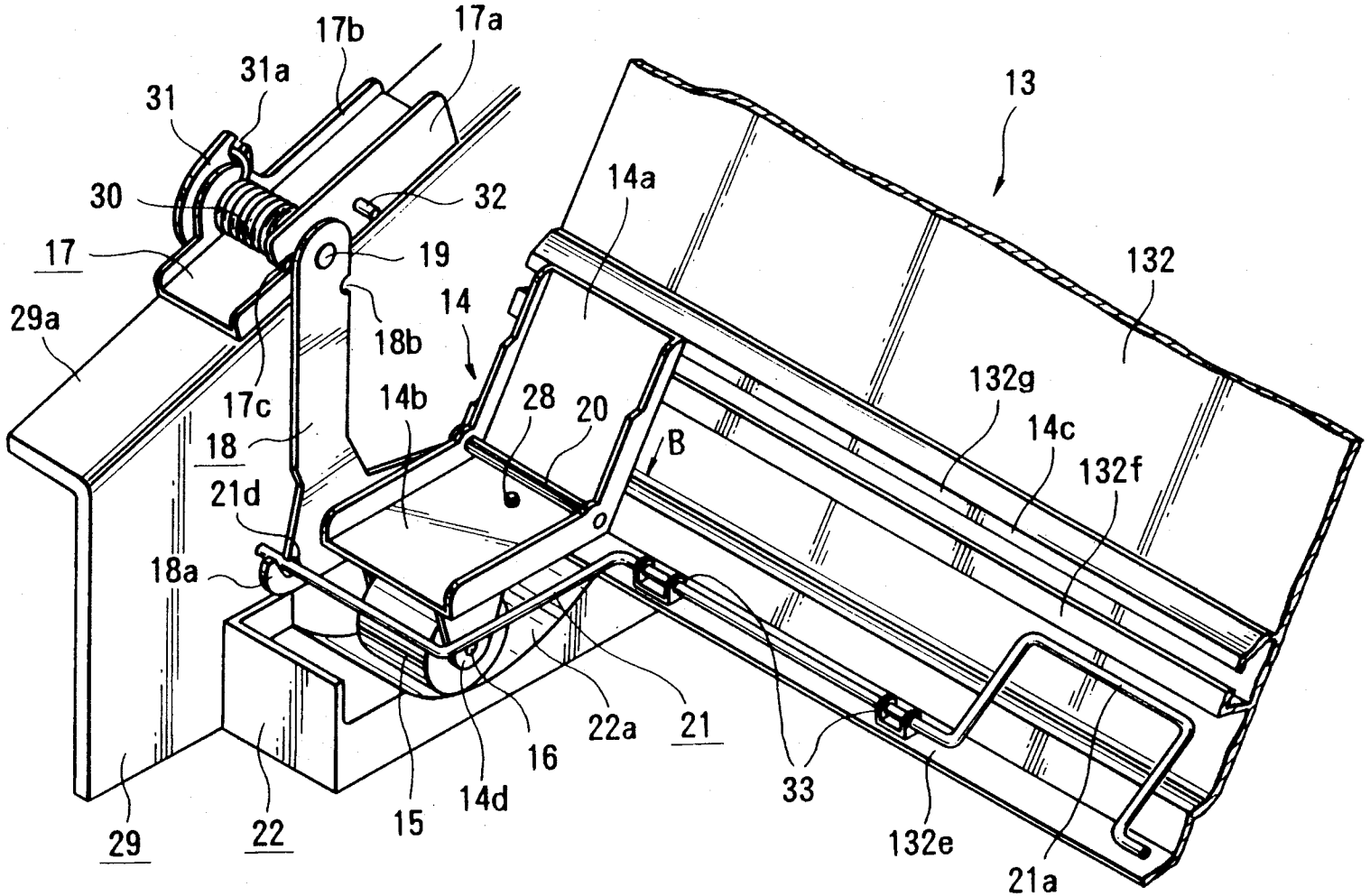
FIG. 4 is a perspective view showing a main part of the keyboard cover opening/closing mechanism.

A metal arm fitting 29 constituting a lower case together with the shelf board 11*b*, the keyslip 11*d*, and the back board 11*c* is integrally formed with the side board 11*c*, and the bracket 17 is fixed to an upper inclined surface 29*a* of the fitting 29, as shown in FIG. 4.

A shaft 17*b* having a torsion coil spring 30 fitted thereon is rotatably supported between both side walls 17*a* and 17*b* of the bracket 17. One end of the lever 18 is fixed to one end of the shaft 19 (the other end of the lever 18 is pivotally supported on a middle portion of the doglegged arm member 14 with the shaft 20), while a spring lock plate 31 having a notched groove 31*a* is fixed to the other end of the shaft 19. One end of the torsion coil spring 30 is fitted in the notched groove 31*a* of the spring lock plate 31 to be locked, while the other end of the spring 30 is fitted in a notched groove 17*c* formed in one side wall 17*a* of the bracket 17 to be locked.

A stopper pin 32 extends from the side wall 17*a* of the bracket 17. When the lever 18 pivots counterclockwise from a position indicated by in FIG. 4, a stopper recess 18*b* of the lever 18 is engaged with the stopper pin 32 at a pivot limit position. As a result, the pivoting movement of the lever 18 is stopped.

The torsion coil spring 30 is set in a neutral state at a certain point in the process of pivoting of the lever 18. When the lever 18 further pivots counterclockwise, a clockwise return force is generated. When the lever pivots clockwise to pass through the middle position, the torsion coil spring 30 is rewound to generate a counterclockwise return force. In a state wherein the lever 18 pivots clockwise to the limit when the cover 13 is open, the maximum counterclockwise return force is generated. Since this force acts as a torque in a direction to raise the keyboard cover 13 against its weight, an external operation force required at the start of closing the cover 13 can be reduced.

Figures 5, 6:
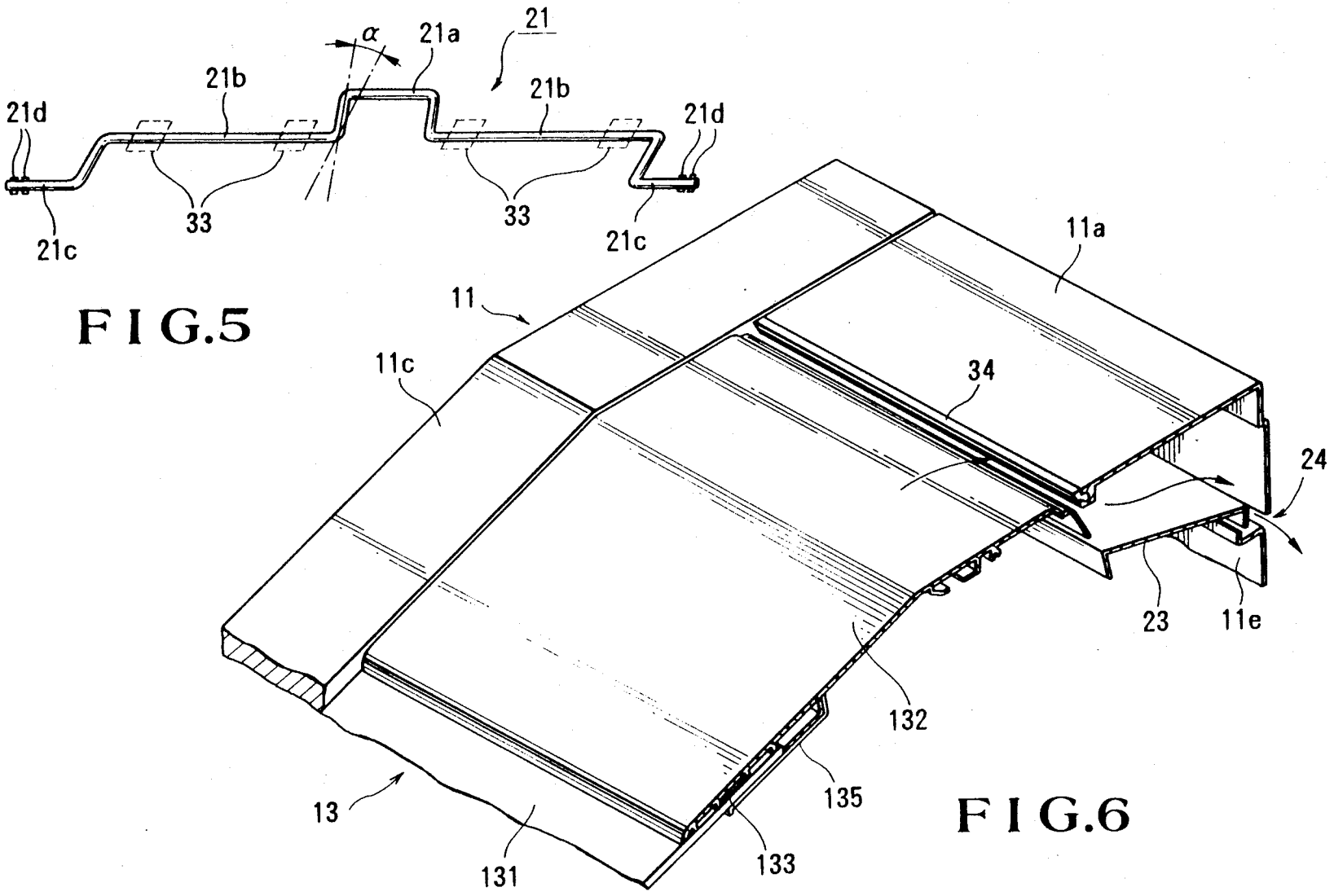
FIG. 5 is a perspective view showing a torsion bar 21 in FIG. 4.
FIG. 6 is a partially cutaway perspective view obtained by obliquely viewing an instrument main body 11 from the above while the keyboard cover 13 is closed.

As shown in FIG. 5, the torsion bar 21 is constituted by intermediate portions 21*b* and end portions 21*c* formed to be symmetrical about a middle projection 21*a* in the form of a crank. Projections 21*d* are formed at the two end portions 21*c* by pressing to prevent the removal of the torsion bar 21.

The intermediate portions 21*b* are fixed to the bent portion 132*e* of the second cover member 132 of the keyboard cover 13 with metal fittings 33 at four positions indicated by dotted lines in FIG. 5, and the projection 21*a* in the middle of the torsion bar 21 is brought into contact with the inner surface of the second cover member 132. In addition, the two end portions 21*c* are respectively fitted in bar receiving portions 18*a* of the left and right levers 18 to be locked, while the removal of the torsion bar 21 is prevented by the projections 21*d* on the two end portions 21*c*.

A torsion angle $\alpha$ of the torsion bar shown in FIG. 5 is normally set to be 28°. However, the angle defined by the lever 18 and the second cover member 132 is changed in accordance with an opening/closing operation of the keyboard cover 13. For this reason, while the cover 13 is kept closed, the torsion angle $\alpha$ becomes about 80°. While the cover 13 is open, the torsion angle $\alpha$ becomes about 48°. With this change in torsion angle $\alpha$, a pivoting torque acting between the keyboard cover 13 and the lever 18 is changed.

FIG. 6 shows the instrument man body 11 while the keyboard cover 13 is kept closed. More specifically, FIG. 6 clearly shows the relationship between the side, top, and back boards 11*c*, 11*a*, and 11*e* of the instrument main body 11, the keyboard cover 13, and the foreign object removal panel 23.

A damping member 34 consisting of a soft resin and having a shape of an arrow is fitted in the front edge of the top board 11*a*.

An operation of this embodiment will be described next.

When the keyboard cover 13 is to be opened, a user puts his/her finger on the finger hook member 138 on the front edge of the cover 13 and raises the cover 13 from the completely closed state of the cover 13 to a position P1 in FIG. 2. The cover 13 is further moved to a cover open position P5 through a position P2 in FIG. 2 and positions P3 and P4 in FIG. 1.

Meanwhile, the roller 15 is moved in constant, rotatable contact with the guide rail surface 22*a* of the roller guide 22. Although this guide rail surface 22*a* can be designed with a considerable degree of freedom, the surface 22*a* is constituted by two large and small arcuated surfaces in this embodiment.

The roller 15 is in rotatable contact with the small arcuated surface, as an upper portion, of the guide rail surface 22*a* from the position P1 to the position P2 in FIG. 2. During this period, the lever 18 is engaged with the stopper pin 32 to be locked at the upper limit position and hence does not pivot, while only the doglegged arm member 14 pivots clockwise about the shaft 20 together with the keyboard cover 13, as shown in FIG. 2.

The keyboard cover 13, therefore, pivots while the second cover member 13 is located at a position very close to the damping member 34 on the front edge of the top board 11*a*.

At the position P1 where the keyboard cover 13 starts to open, the angle defined between the cover 13 and the torsion bar arranged between the bar receiving portion 18 of the lever 18 and the cover 13 (indicated by solid lines) is about 100°, and the torsion angle is about 80°. In this state, a relatively large rotating torque from the torsion bar 21 acts on the keyboard cover 13 in a direction to open the cover 13 against a rotating torque based on the weight of the cover 13 in a direction to close the cover 13. As a result, the keyboard cover 13 can be raised with a relatively small force.

As the keyboard cover 13 is gradually opened, since the doglegged arm member 14 is rotated clockwise in FIG. 2 with respect to the lever 18, the torsion angle of the torsion bar 21 is reduced. However, since the counterclockwise torque based on the weight of the keyboard cover 13 is also reduced, the counterclockwise and clockwise torques balance each other.

At the position P3 in FIG. 1, the roller 15 reaches the projection of the guide rail 22*a*. Thereafter, when the roller 15 is moved to the large arcuated surface below the projection, the lever 18 pivots clockwise in FIG. 1, and the second cover member 132 of the keyboard cover 13 begins to be stored in the instrument main body 11 through the gap between the rear end of the musical stand 26 and the front end of the top board 11*a*.

Since the return force of the torsion coil spring 30 shown in FIG. 4 acts in a direction to pull the keyboard cover 13 in the instrument main body 11 at this time, the second cover member 132 is smoothly stored with this force in combination of the effect of the torsion bar 21.

At the position P4 in FIG. 1, the torsion angle of the torsion bar 21 is set to the normal angle of 28° and hence no biasing force is generated, while the torsion coil spring 30 is set in a neutral state in which no pulling force acts. However, the keyboard cover 13 pivots clockwise to be lowered due to a pivoting force based on the weight of the cover 13.

With this operation, the torsion angle of the torsion bar 21 is increased again to produce a damping force. At the same time, the torsion coil spring 30 is rewound to generate a damping force which is increased with the clockwise rotation of the lever 1. These damping forces prevent the keyboard cover 13 from abruptly descending and allow the roller 15 to be smoothly lowered in rolling contact with the guide rail surface 22*a*. As a result, the keyboard cover 13 is set at the cover open position P5 indicated by the solid lines in FIG. 1.

Meanwhile, the path of the keyboard cover 13 is restricted by the guide rail surface 22*a* such that the outer surface of the second cover member 132 of the cover 13 is always kept close to the damping member 34.

The path of the keyboard cover 13, therefore, can be freely designed in accordance with the shape of the guide surface of the guide member. The gap between the damping member 34 and the keyboard cover 13 can be greatly reduced by causing the keyboard cover 13 to always pivot along the front end of the top board 11*a* of the instrument main body 11.

There is still a possibility that a musical score, a piece of paper, a clip, or the like falls inside the instrument main body through the small gap. Even if such an accident occurs, an object slides down over the foreign object removal panel 23 to be removed outside from the gap formed between the top board 11*a* and the back board 11*e*.

With this arrangement, therefore, the instrument of the present invention requires neither a large dust cover as in the conventional instrument nor an opening/closing mechanism and a removal mechanism which is designed such that the top board 11*a* is caused to pivot to open an upper portion of the instrument main body 11 so as to remove an object which has fallen inside the instrument main body.

In addition, since the path of the rear end portion of the keyboard cover 13 within the instrument main body 11 can be restricted by the roller guide 22, the space required for the pivoting movement can be reduced as compared with the conventional instrument. With this reduction in space, the space for mounting a component such as the transformer 27 can be easily ensured.

Although the transformer 27 seems to extend in the path of the roller 15 in FIGS. 1 and 2, it does not interfere with the movement of the roller 15 unless it extends in the path of the rear end portion of the keyboard cover 13 because the opening/closing mechanism other than the keyboard cover 13 is arranged on only the two side portions of the instrument main body 11.

When the keyboard cover 13 is to be closed, a user holds the distal end portion of the cover 13 at the position P5 in FIG. 1 and pulls while raising it to cause the cover 13 to pivot through a process reverse to that described above, i.e., from the position P4 to the position P3 in FIG. 1 and from the position P2 to the position P in FIG. 2.

In this embodiment, two types of elastic members having different elastic moduli, i.e., the torsion bar 21 and the torsion coil spring 30 are arranged so that the return forces act at the cover open position and the cover close position in accordance with an opening/-closing operation of the keyboard cover 13, and the return forces become zero at the middle position between the cover open and close positions, thereby balancing the pivoting force based on the weight of the keyboard cover 13. Therefore, the operating forces required at the cover open position, the cover close position, and the middle position can be made substantially uniform.

In addition, a strong return force can be caused to act at least at a position near the closed position of the keyboard cover 13 by using the torsion bar 21. That is, a uniform return force can be easily caused to act on both the sides by using the single torsion bar, thus preventing the fingers of a user from being caught in the gap between the front end of the keyboard cover and the instrument main body upon closing of the cover and in the gap between the outer surface of the keyboard cover and the front end of the top board upon opening of the cover.

If the torsion angles of the torsion bar 21 at the cover open position, the cover close position, and the middle position are respectively represented by $\alpha 1$, $\alpha 2$, and $\alpha 3$, these angles are set in the above-described embodiment as follows: $\alpha 1=80°$, $\alpha 2=48°$, and $\alpha 3=28°$. However, the present invention is not limited to this. These torsion angles can be arbitrarily set as long as $\alpha 1>\alpha 2>\alpha 3$.

Furthermore, in this embodiment, the torsion coil spring is used as an auxiliary member for the damping effect of the torsion bar at the time of closing of the cover. However, the torsion coil spring may be used as an auxiliary member for the damping effect of the torsion bar at the time of closing of the cover.

Moreover, the torsion coil spring may be used an auxiliary member for the damping effect of the torsion bar at the time of both opening and closing of the cover. The torsion coil spring may be used as a main supplementary force generating means while the torsion bar is used as an auxiliary supplementary force generating means. Alteratively, one of these members may be used as a supplementary force generating means, or another supplementary force generating means may be used.

In the embodiment described above, the rear end portion of the musical stand 26 or the front end portion of the top board 11*a* serves as a means for to be in contact with the guide rail surface 22*a* of the roller guide 22 as a guide member during an opening/closing operation of the keyboard cover 13. Another embodiment in which this means is modified will be described below with reference to FIGS. 7 and 8.

Figure 7:
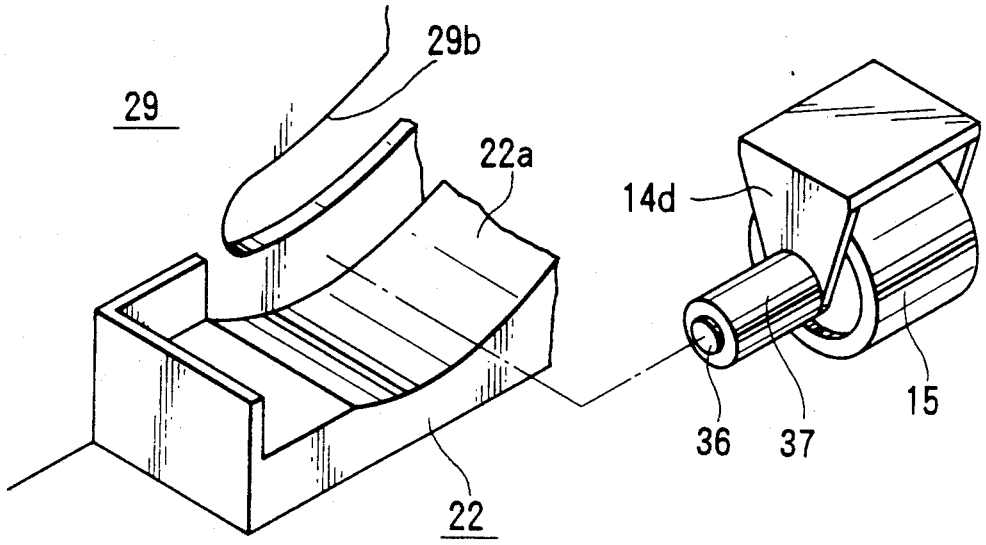
FIG. 7 is a perspective view showing only a main part of another embodiment of the present invention.
Figure 8:
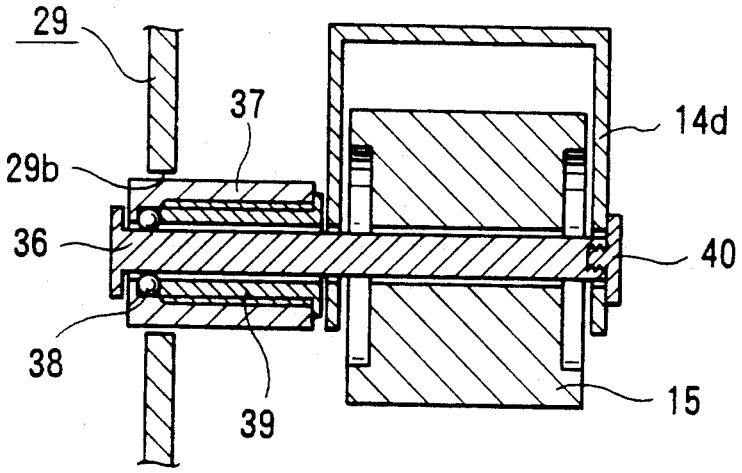
FIG. 8 is a sectional view thereof.
Figure 9:
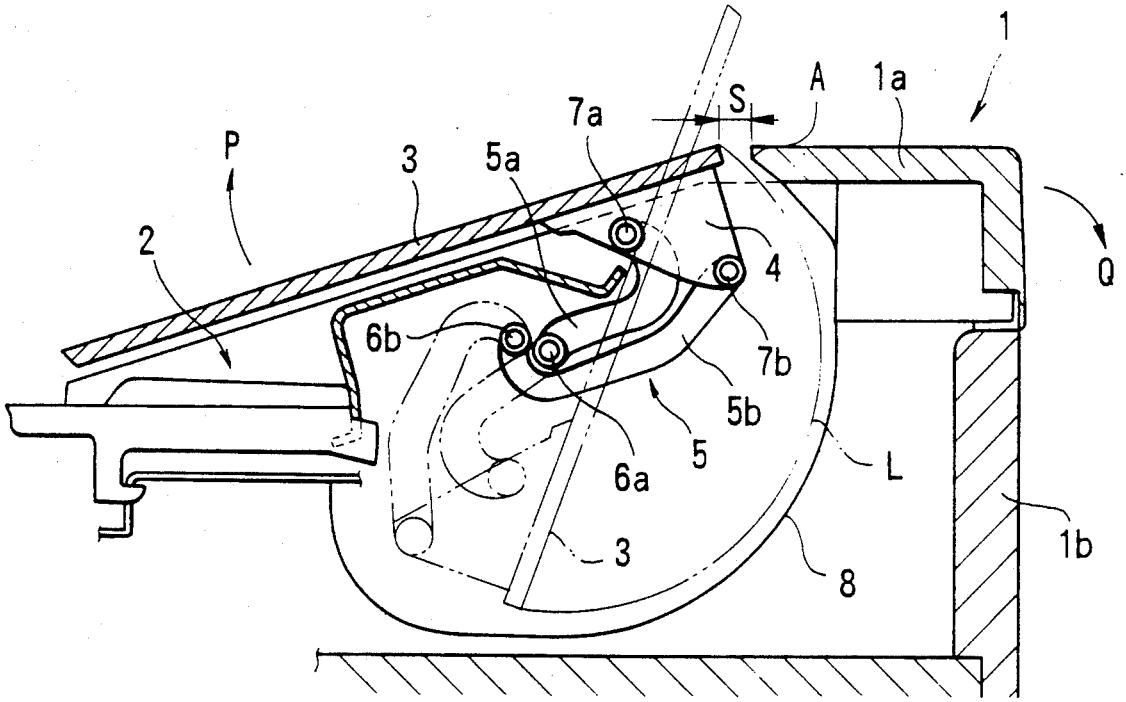
FIG.9 PRIOR ART
FIG. 9 is a sectional view, of an instrument main body, showing a keyboard cover opening/closing mechanism of a conventional keyboard instrument.
Figure 10A:
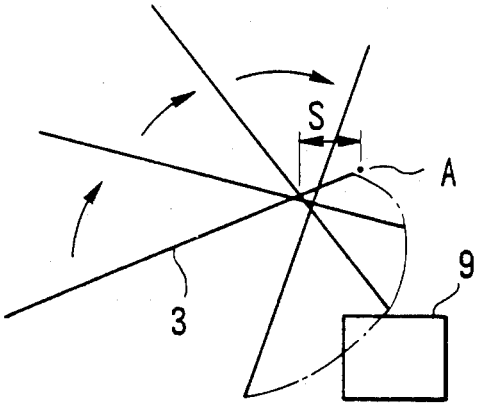
FIG.10A PRIOR ART
FIGS. 10A and 10B are views for explaining the movement of the keyboard covers in closing/opening operations performed by the keyboard cover opening/closing mechanisms according to the prior art and the present invention, respectively.
Figure 10B:
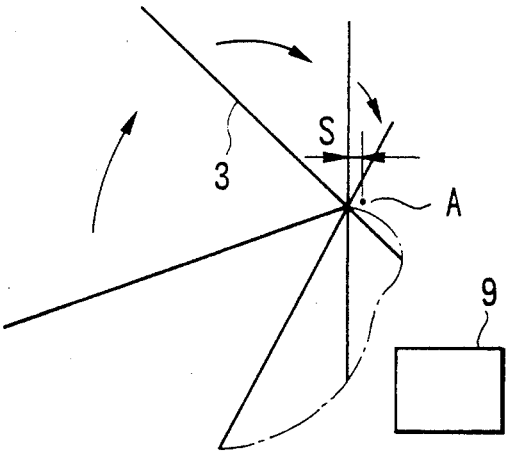

The same reference numerals in FIGS. 7 and 8 denote the same parts as in FIG. 4, and a description thereof will be omitted.

In this embodiment, an auxiliary roller 37 is rotatably supported on a U-shaped support piece 14*d*, which is fixed to a member similar to the doglegged arm member 14 in FIG. 4, with a shaft 36 common to a roller 15. The roller 37 is inserted in a guide slot 29*b* formed in a metal arm fitting 29 along a guide rail 22*a* of a roller guide 22 so as to be in rolling contact with the upper and lower inner surfaces of the guide slot 29*b*.

As shown in FIG. 8, the auxiliary roller 37 rotatably supported by the shaft 36 through a plurality of balls 36 whose removal is prevented by the threadable engagement of a cylindrical screw 39. The shaft 36 penetrates through the auxiliary roller 37, the cylindrical screw 39, the roller support piece 14*d*, and the roller 15 and is threadably engaged with a flat screw 40 so as not to be removed.

According to this embodiment, although the auxiliary roller 37 is moved while it is rotated within the guide slot 29*b* of the arm fitting 29, since the center of the roller 37 is always restricted to a position separated from the guide rail surface 22*a* by a distance corresponding to the radius of the roller 15, the roller 15 can be caused to be always in contact with the guide rail surface 22*a*.

Other arrangements and operations are the same as those in the embodiment described above.

Although not shown, the guide rail portion of the roller guide may be formed to have a U-shaped cross section, and the roller 15 is cantilevered and inserted in the guide rail portion, thus always causing the roller 15 to be in contact with the guide rail portion.

Alternatively, the guide rail surface of the roller guide may be constituted by a magnetic member (e.g., iron), while the roller is constituted by a magnetic roller.

Figure 11:
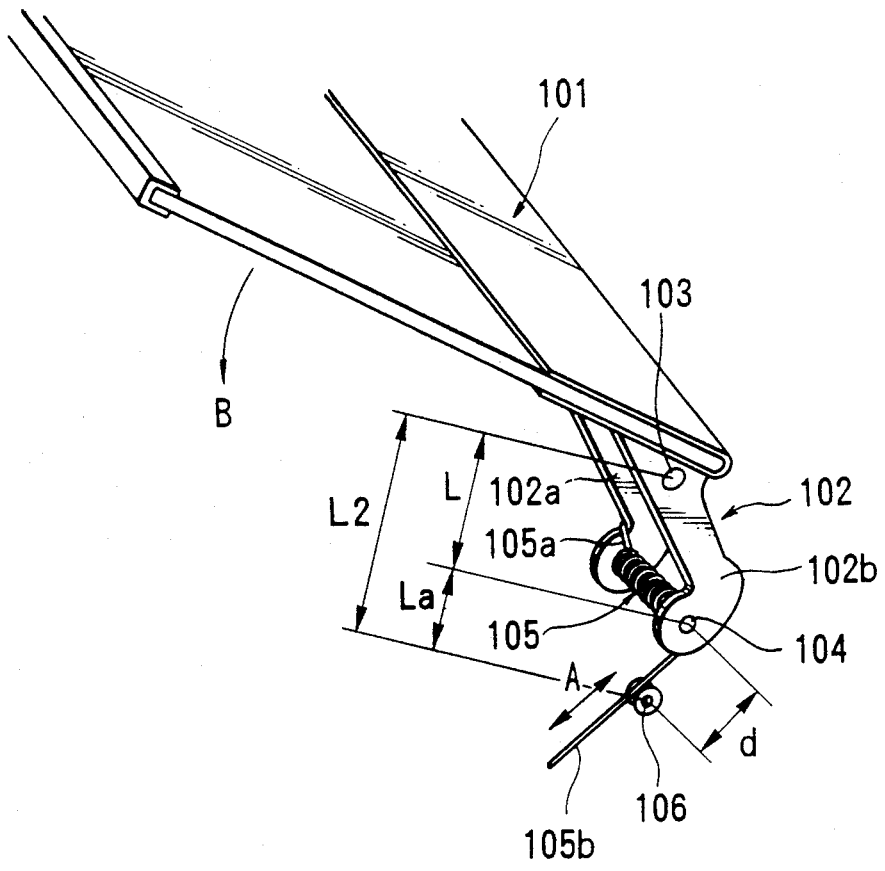
FIG. 11 is a perspective view showing a main part of still another embodiment of the present invention.

FIG. 11 shows still another embodiment of the present invention. Referring to FIG. 11, reference numeral 101 denotes a keyboard cover; and 102, arm members fixed to two side portions near the rear end of the cover 101, each of which is constituted by two parallel arm pieces 102*a* and 102*b*. A pivot center 103 of each arm member 102 is pivotally supported by a support member (not shown) on the instrument main body side.

A shaft 104 having a torsion coil spring 105 as an elastic member fitted thereon is fixed between the arm pieces 102*a* and 102*b* on the free end side of the arm member 102. One end 105*a* of the torsion coil spring 105 is engaged with the arm piece 102*a*, while a linear extended portion 105*b* as the other end is engaged with a groove of a pulley 106 rotatably supported on the instrument main body side, thereby supporting the arm member 102 to be freely moved in a direction indicated by an arrow A upon pivoting of the keyboard cover 101.

By attaching the torsion coil spring 105 at a position separated from the pivot center 103 of the keyboard cover 101 by a distance L, since the rotational moment can be increased with an increase in length of the arm portion, a large damping effect can be obtained with a small spring. Furthermore, in this embodiment, the torsion coil spring 105 is fixed to a rotating member as the keyboard cover 101, and an biasing end portion of the torsion coil spring 105 is arranged at a predetermined position of an extended portion 20*b* so as to add a distance La to the length of the arm portion. Therefore, the rotational moment can be further increased so that a larger damping force can be obtained with a smaller spring.

With this arrangement, when the keyboard cover 1 is to be closed in a direction indicated by an arrow B, the pivoting force in the direction indicated by the arrow B, which is based on the weight of the cover 101, substantially balances the damping force of the torsion coil spring 5, which acts on the cover 101. Therefore, the keyboard cover 101 can be safely and smoothly opened/closed with a uniform small operating force.

At this time, the damping force of the torsion coil spring 105 is increased with an increase in torsion angle defined by the two ends 105*a* and 105*b*. In most part of the path of the keyboard cover 101, the torsion angle is increased with a decrease in the degree of opening of the cover 101, and hence the damping effect is enhanced to cancel out an increase in pivoting force in the direction to close the cover 101, which is based on the weight of the cover 101. However, since the torsion coil spring 105 is moved upon pivoting of the keyboard cover 101, a distance d between the center of the spring 105 and a point at which the linear extended portion 5*b* and the pulley 6 are engaged with each other is also changed.

The force (damping force), of the torsion coil spring 5, for raising the keyboard cover 101 is increased in proportion to an increase in distance d. Therefore, by changing the shape of the arm member 102 and adjusting the position of the pulley 6, the damping effect at a position where the keyboard cover 101 is almost closed while it opposes the upper surface of the instrument main body can be reduced, or its change rate (increase rate in this case) can be reduced as compared with the damping effects in other parts of the path of the cover 101.

That is, the path of the shaft 4 is set to reduce the distance d at a position immediately before the end of closing operation of the keyboard cover 101.

With this arrangement, at the time immediately before the keyboard cover 101 is closed, the damping effect of the torsion coil spring 105 is reduced, and the pivoting force in the direction to close the cover 101, which is based on the weight of the cover 101, is slightly increased. For this reason, the keyboard cover 101 is completely closed and brought into contact with the cover abutment portion of the instrument main body, thus ensuring a reliable closing operation of the cover 101 and obtaining a sense of closing of the cover 101 and reliability.

Note that a supplementary damping effect based on the frictional force of a shaft portion may be used.

Since the keyboard cover 101 is generally stopped while it is inclined backward when it is to be opened, a torsion coil spring similar to the above-described torsion coil spring may be arranged while the locking direction of its two ends is reversed, in order to also obtain a damping effect near the cover open position.

Still another embodiment of the present invention will be described below with reference to FIG. 12 and the subsequent drawings.

Figure 17:
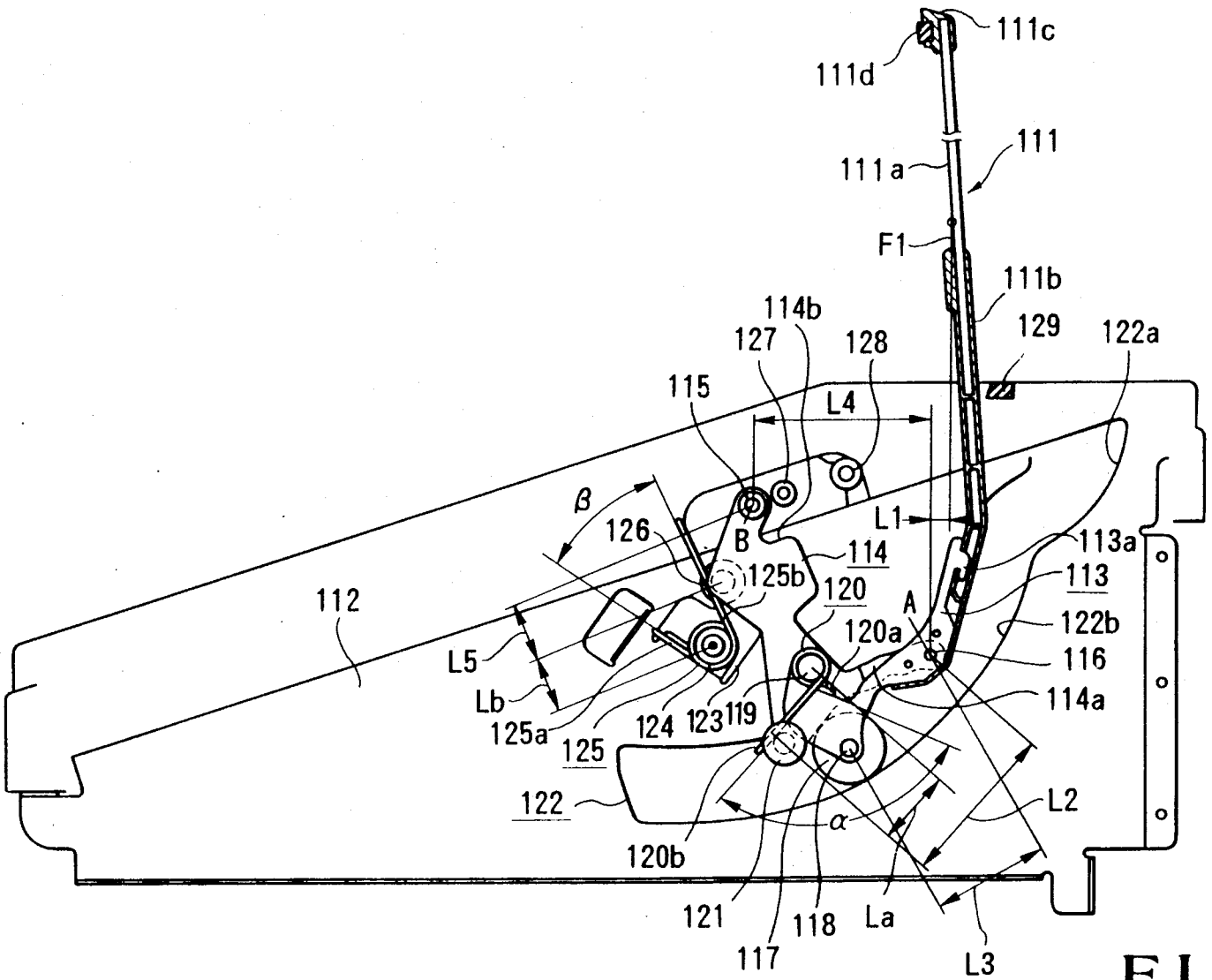
Figure 18:
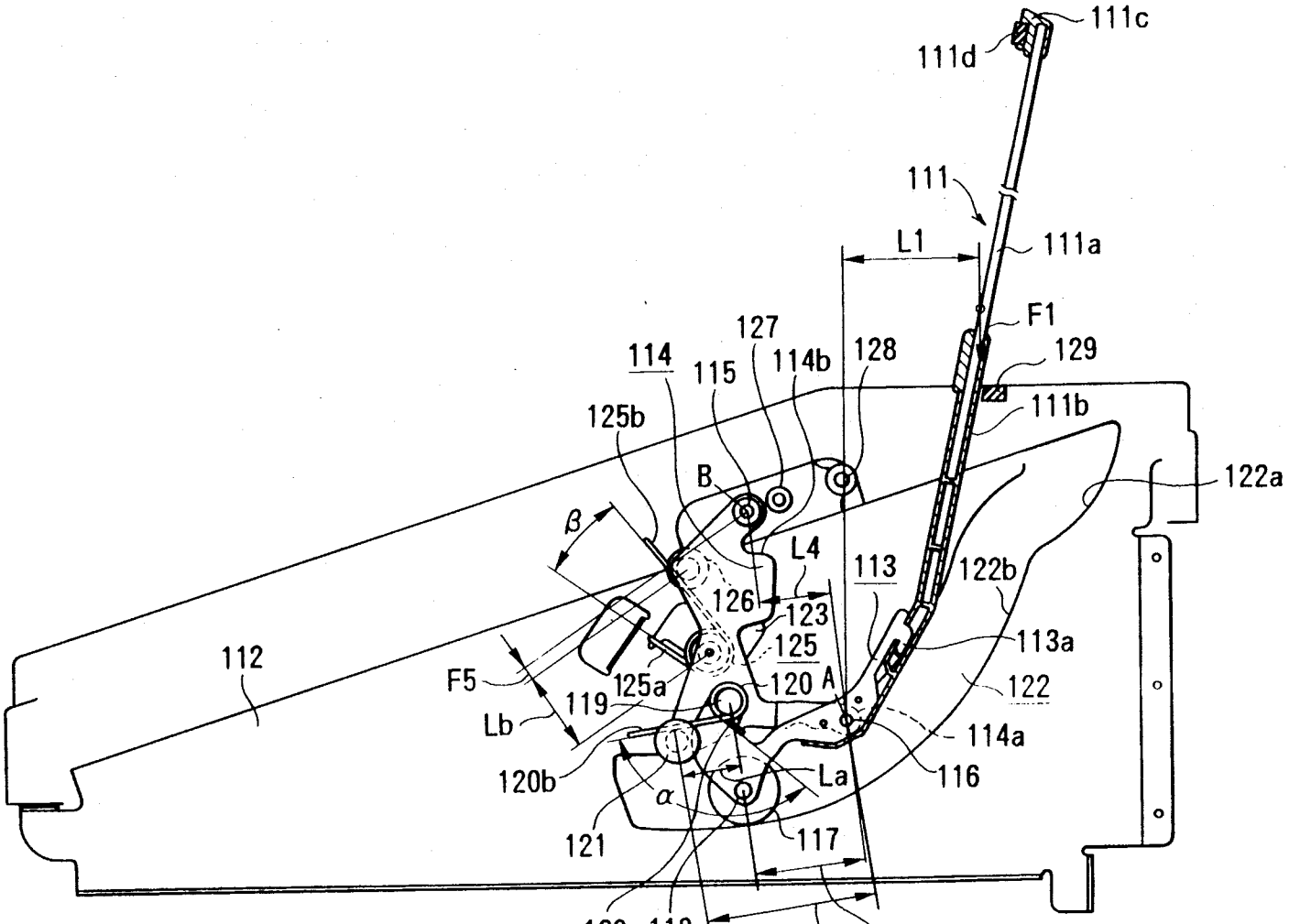
Figure 19:
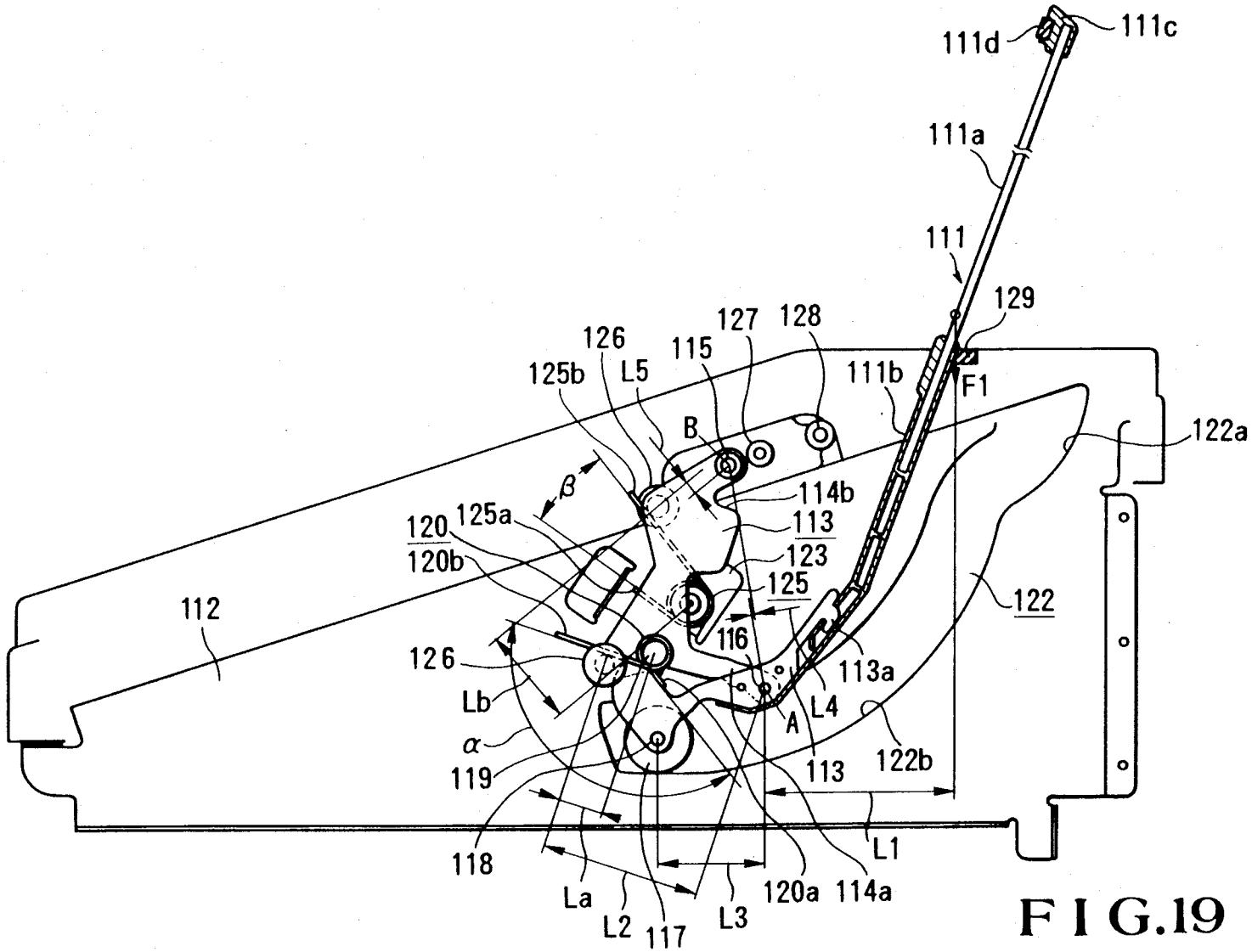

FIGS. 12 to 19 show the interior of a keyboard instrument, to which the present invention is applied, except for components which are not required for the description of a keyboard cover opening/closing mechanism while only a keyboard cover is shown in a cross section. FIGS. 12 to 19 respectively show eight different open states of the keyboard cover from a completely closed state (FIG. 12) to a completely open state (FIG. 19).

In this electronic keyboard instrument, a keyboard cover 111 is supported on an instrument main body 110 to be freely opened/closed. While the instrument is not used, the keyboard cover 111 is closed to cover and protect upper and lower keyboards (not shown) in the instrument main body 111.

Figure 12:
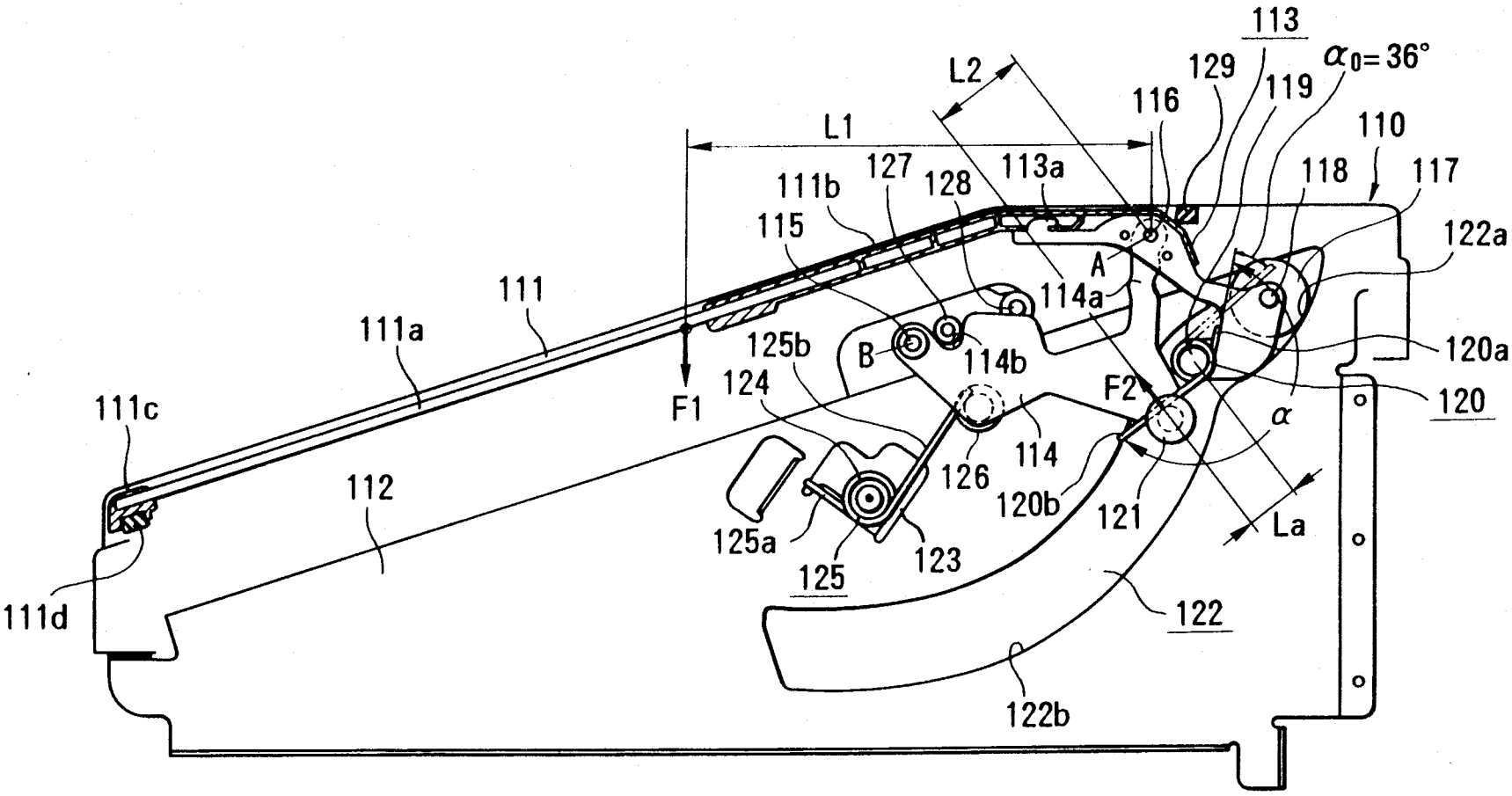
FIGS. 12 to 19 are sectional views of various states of a keyboard cover at different opening degrees according to still another embodiment of the present invention, showing only portions required for the description of a keyboard cover opening/closing mechanism while only the keyboard cover is shown in cross section.

A keyboard cover opening/closing mechanism shown in FIG. 12 is arranged on two side portions in the instrument main body 110.

The keyboard cover 111 comprises a first cover member 111*a*, as the front half portion of the cover 111, consisting of a transparent resin such as an acrylic resin, and a second cover member 111*b*, as the rear half portion of the cover 111, consisting of a metal such as aluminum. A joint portion of the two members is fixed from the lower surface side with screws and the like.

A finger hook member 111*c* and a cushion member 111*d*, both consisting of a resin, are attached to the front edge portion of the first cover member 111*a*.

A first arm member 113 is fixed near the rear end of the second cover member 111*b* with a lock portion 13*a* at the front end of the arm member 13 being engaged with the cover member 111*b*. An arm portion 114*a* of a second arm member 114 pivotally supported on a side board 112 with a shaft 115 is supported on the first arm member 113 with a shaft 116 to be relatively pivotal.

A roller 117 is rotatably supported on a rear expanded portion formed on the rear end portion of the first arm member 113 with a shaft 118. A shaft 119 is fixed to the front expanded portion and a first torsion coil spring (to be referred to as a first spring hereinafter) 120 is fitted on the shaft 119.

One extended portion 120*a* of the first spring 120 is hooked on the first arm member 113 to be locked, whereas a linear extended portion 120*b* as the other end of the first spring 120 is engaged with a groove of a first pulley 121 rotatably supported on an expanded portion, of the second arm member 114, on a side opposite to the arm portion 114*a*.

A guide groove is formed in the side board 112. The guide groove is formed by continuously forming a small arcuated first guide surface 122*a* and a large arcuated second guide surface 122*b* on the side board 112 itself or an independent guide member. The roller 117 axially supported by a first arm member 113 is inserted in the guide groove so as to be in rolling contact with the first and second guide surfaces 122*a* and 122*b*.

Figure 13:
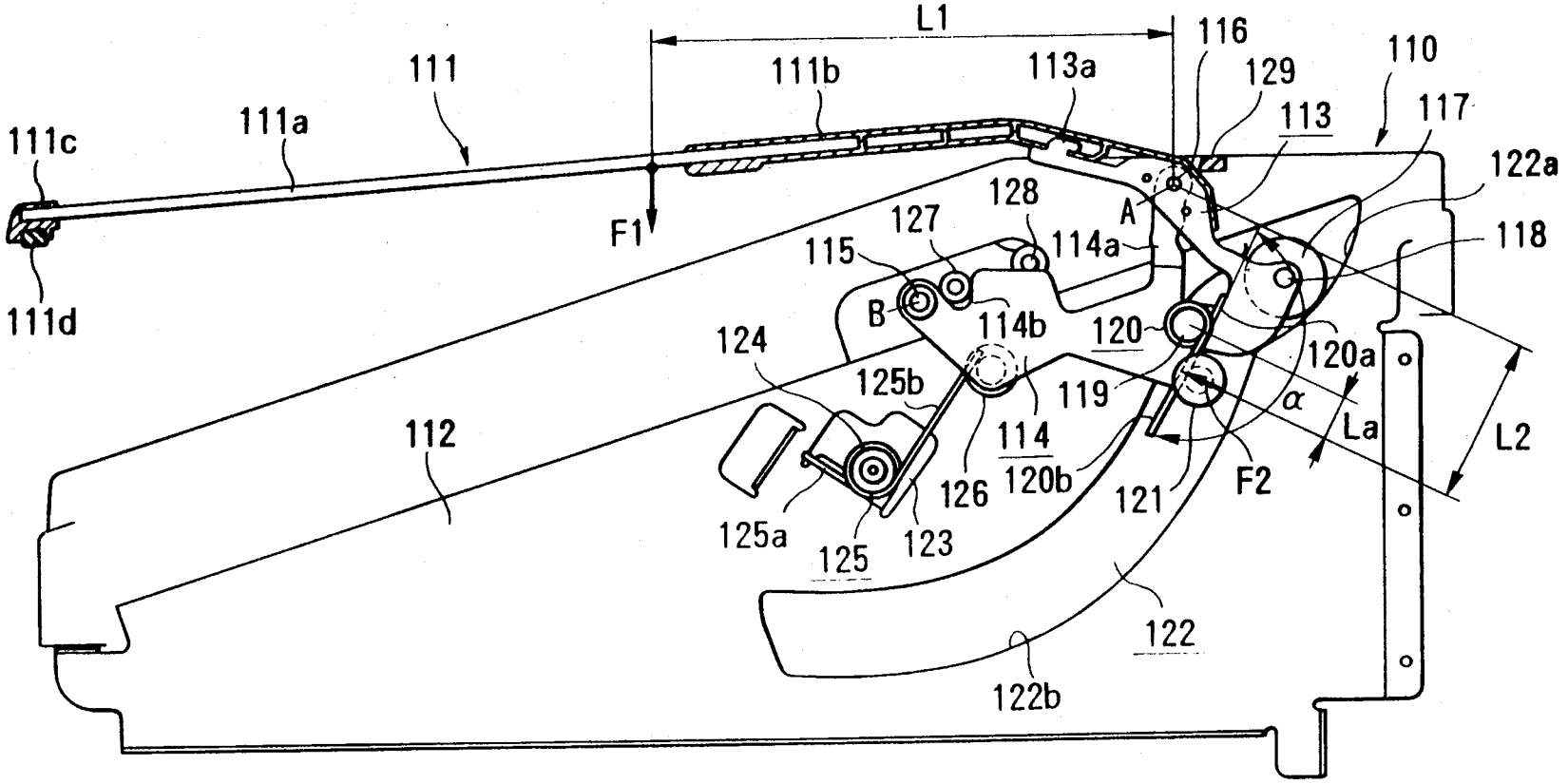
Figure 14:
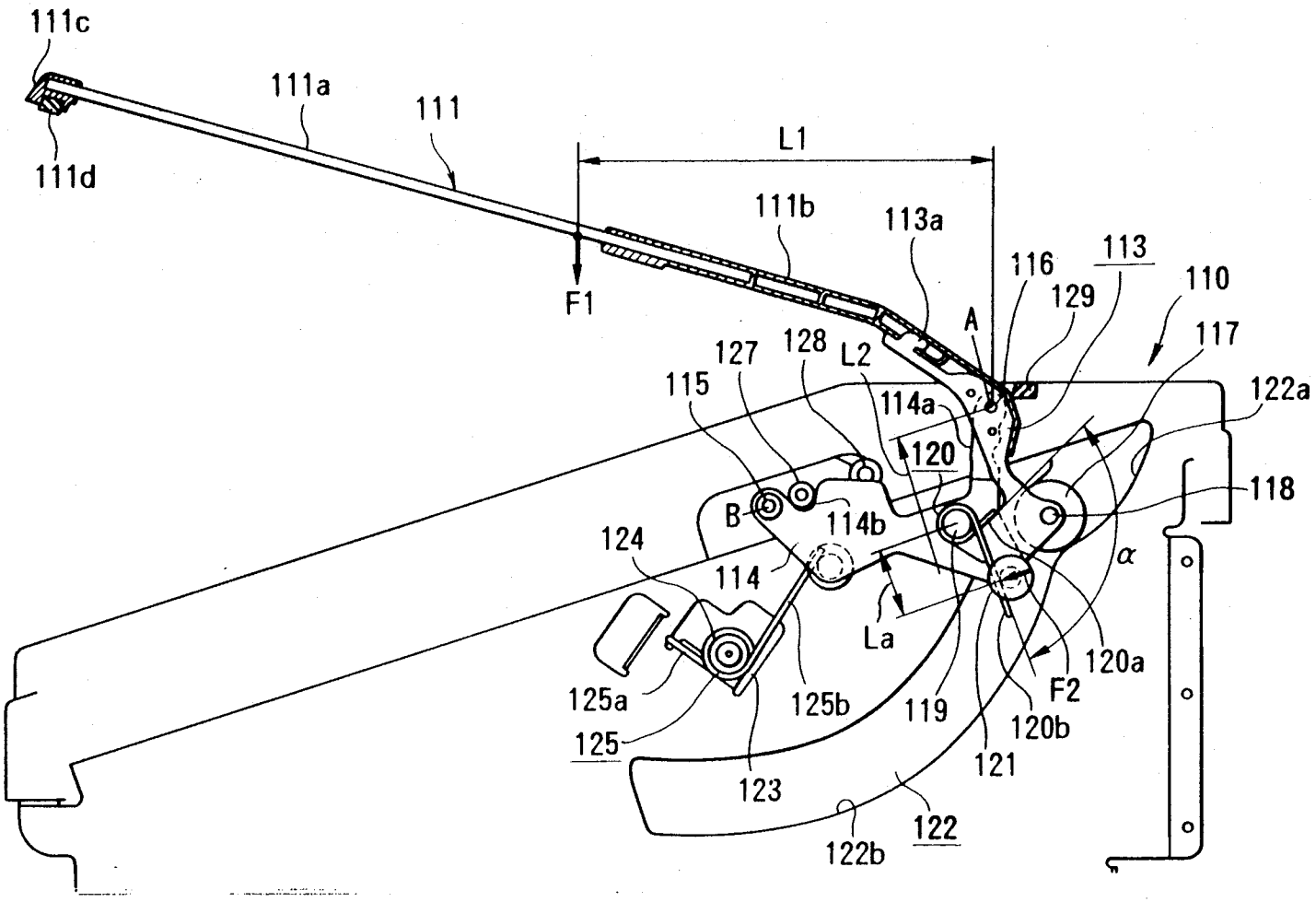

The first guide surface 122*a* is formed into an arcuated shape with the shaft 116 being considered as the center when the second arm member 114 is locked to the upper limit position shown in FIGS. 12 to 14. The second guide surface 122*b* is formed such that its upper half portion has an arcuated shape with the fixed shaft 115 for pivotally supporting the second arm member 114 being considered as the center, and the lower half portion has an arcuated shape whose diameter is gradually increased.

In addition, a shaft 124 is fixed to a bracket 123 attached to the side board 112. A second torsion coil spring 123 (to be referred to as a second spring hereinafter) is fitted on the shaft 124, while one extended portion 125*a* of the spring 123 is hooked on the bracket 123 to be locked, and the other linear extended portion 125*b* is engaged with a groove of a second pulley 126 rotatably supported on an expanded portion in the middle of the second arm member 114.

Reference numeral 127 denotes a guide roller fitted in a notched portion 114*b* of the second arm member 114; 128, a stopper for restricting the upper limit position of the second arm member 114; and 129, a cover abutment member constituted by a cushion member with which the keyboard cover 111 is brought into contact when the cover 111 is completely open. All these members are attached to the inner surface of the side board 112.

In this embodiment, the first spring 120 mainly serves as an elastic member for generating a biasing force to damp the pivoting force of the keyboard cover 111 which is based on its weight and acts in a direction to close it near the cover close position. The second spring 125 mainly serves as an elastic member for generating a biasing force to damp the pivoting force of the keyboard cover 111 which is based on its weight and acts in a direction to open it near the cover open position.

While the keyboard cover 111 is completely closed as shown in FIG. 12, the roller 117 is set in rolling contact with the upper portion of the guide surface 22*a*. Assume that a user puts his/her finger on the finger hook member 111*c* and moves the keyboard cover 111 upward from this state. In this case, the second arm member 114 is kept at the upper limit position where it is in contact with the stopper 128 until the keyboard cover 111 is raised from a substantially horizontal state shown in FIG. 3 to a state shown in FIG. 14 in which the front end of the cover 111 reaches a position slightly higher than the horizontal level. Subsequently, the keyboard cover 111 pivots about the shaft 116 in a direction to be opened, while the roller is lowered in rolling contact with the first guide surface 122*a*.

In this case, the first spring 20 generates a rotational moment acting in the direction to open the keyboard cover 111, so as to cancel out the pivoting force base on the weight of the cover 111 and acting in the direction to close it, in accordance with a torsion angel $\alpha$ defined by the two extended portions 120*a* and 120*b* of the first spring 120 (imaginary lines in FIG. 12 indicate the position of the other extended portion 120*b* in relation to one extended portion 120*a* in a neutral state, and an initial torsion angle $\alpha_0=36°$), the distance (the length of an arm portion) between a pivot center A of the keyboard cover 111 and the intersection where the pivot center A crosses, at a right angle, an urging force F2 of the first pulley 121 against the spring 120 at the engagement point between the pulley 121 and the extended portion 120*b* of the spring 120, and a repulsive force F2 of the second spring 120. Therefore, the keyboard cover 111 can be opened with a relatively small force.

Figure 15:
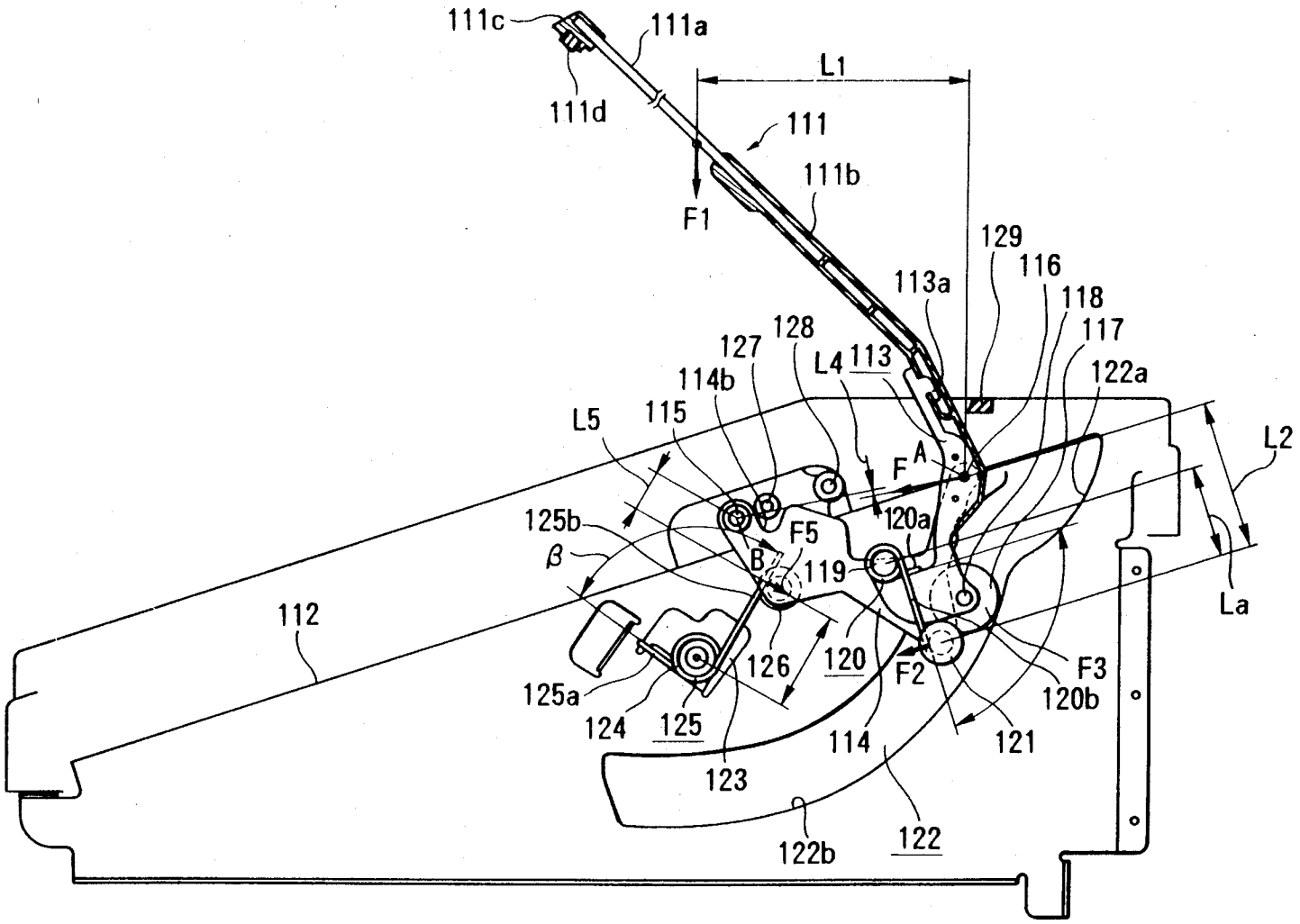

Rolling contact of the roller 117 with the second guide surface starts from a state shown in FIG. 15. The second arm member 114 pivots about the shaft 115 clockwise in FIG. 15, and the second pulley 126 is moved to reduce an open angle $\alpha$ of the second spring 125 (if the initial open angle $\beta=95°$, $\beta-95°$ is substantially equal to a torsion angle: an effective torsion angle). In addition, a distance Lb between the center of the second spring 125 and the engagement point between the extended portion 125*b* and the second pulley 126 is changed. As a result, a biasing force corresponding to the torsion angle $\beta-95°$ and the distance Lb acts against the pivoting force acting in the direction to open the keyboard cover 111.

This biasing force of the second spring 125 provides a damping effect with respect to the pivoting force based on the weight of the keyboard cover 111 which acts in the direction to open the cover 111 when it pivots from the vertical state in the direction to be opened, thereby restricting the abrupt pivoting movement of the keyboard cover 111 in the direction to completely open the cover 111.

When the keyboard cover 111 is to be closed from the completely open state shown in FIG. 19, a damping effect similar to that described above is generated by the first and second springs 120 and 125 in the revere manner to that described above, thus allowing a reliable closing operation with a small force.

Figure 16:
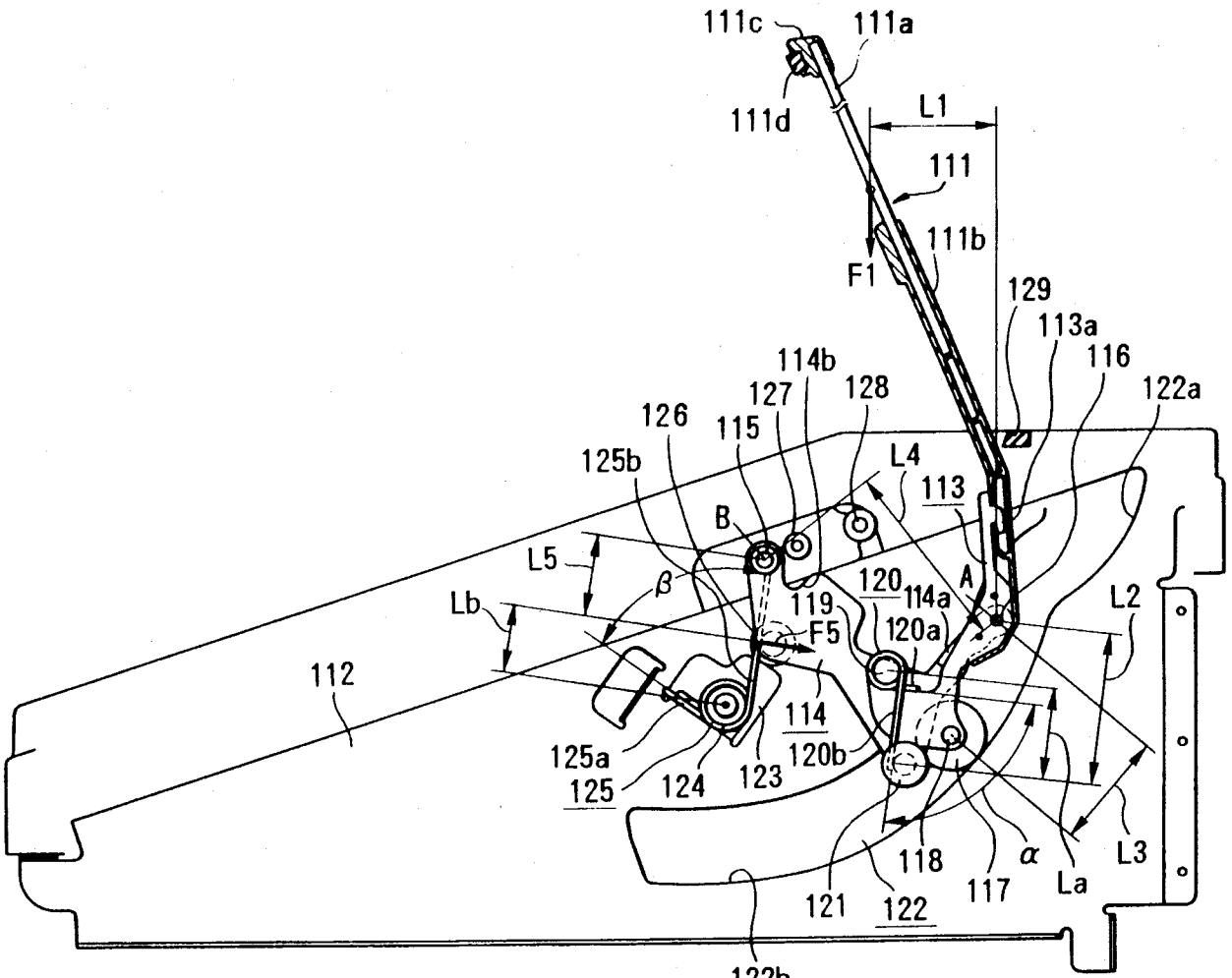

FIGS. 20 to 27 respectively show values of distances L1 to L5, forces F1 to F5, and rotational moments T1 to T5 and T in the states shown in FIGS. 12 to 19. Note that FIG. 12 corresponds to FIG. 20; FIG. 13, to FIG. 21; FIG. 14, to FIG. 22; FIG. 15, to FIG. 23; FIG. 16, to FIG. 24; FIG. 17, to FIG. 25; FIG. 18, to FIG. 26; and FIG. 19, to FIG. 27.

The meanings of these reference symbols L1 to L5, La, Lb, F1 to F5, T1 to T5, T, $\alpha$, and $\beta$ will be described below:

F1: 2 kg, i.e., ½ the weight of the keyboard cover 111 (provided that the total weight of the keyboard cover 111 is 4 kg, and similar mechanisms are arranged on both the sides of the cover 111) (Note that the forces F1 to F5 are vectors);

L1: a horizontal distance (mm) between the center of gravity of the keyboard cover 111 in the forward/backward direction, and the center (point A) of the shaft 116;

T1: a rotational moment (kg·mm) about the point A due to the weight of the keyboard cover 111, provided that a clockwise moment is positive (In the following description, the clockwise direction of each rotational moment is positive.);

F2: a repulsive force (kg) (always acting as a force for pushing the keyboard cover 111 upward due to the return force of the first spring 120) that the extended portion 120*b* of the first spring 120 receives from the engagement point with the first pulley 121;

L2: the length (mm) of an arm portion for determining the rotational moment about the point A which is generated by the first spring 120;

T2: a rotational moment (kg·mm) about the point A which is generated by the first spring 120;

F3: a force (kg) that the roller 117 receives from the guide surfaces 122*a* and 122*b*;

L3: the distance (mm) between the point A and the intersection at which the point A crosses, at a right angle, a vector (F3) that the roller 117 receives from the guide surfaces 122*a* and 122*b*;

T3: a rotational moment (kg·mm) that a hand or a finger of a user receives in the process of opening the keyboard cover 111;

F4: the resultant force of the forces F1, F2, and F3 at the point A;

L4: the distance (mm) between a point B and the intersection at which the point B crosses the point B at a right angle;

T4: a rotational moment (kg·mm) about the point B which is based on the force F4 and the distance L4 and acts on the second arm member 114;

F5: the force of the second spring 125 which acts on the pulley 126;

L5: the distance (mm) between the point B and the intersection at which the point B crosses the force F5 at a right angle;

T5: a rotational moment (kg·mm) about the point B which is based on the force F4 and the distance L5 and acts on the second arm member 114;

La: the distance between the center of the first spring 120 and the intersection at which the center of the spring 120 crosses the force F2 at a right angle;

Lb: the distance between the center of the second spring 125 and the intersection at which the center of the spring 125 crosses the force F5 at a right angle;

T: a synthetic rotational moment (kg·mm) about the point B which acts on the second arm member 114 (in this case, if the spring constant of the first spring 120 is 0.6 kgmm/deg, the initial torsion angle is 36°, the spring constant of the second spring 125 is 1.54 kgmm/deg, and the initial open angle is 95°, the following equations can be established:

$$T1 = F1 \times L1$$

$$F2 = 0.6(\alpha - 36)/La$$

$$T2 = F2 \cdot L2$$

$$T1 - T2 - T3 = 0$$

$$T3 = -(T1 - T2)$$

$$F3 = -(T1 - T2)/L3$$

$$T4 = L4 \cdot F4$$

$$F5 = 1.54 \cdot (\beta - 95)/Lb$$

$$T5 = -F5 \cdot L5$$

$$T = T4 - T5$$

where $\alpha$: the torsion angle (open) of the first spring (degree);

$\alpha - 36$: the effective torsion angle of the first spring 120 (degree);

$\beta$: the torsion angle (open) of the second spring 125 (degree); and $\beta - 95$: the effective torsion angle of the second spring 125 (degree)).

That is, T1 to T5 are the rotational moments about the point A or B which act on the first arm member (substantially the same as the keyboard cover 111 because the member is integrated therewith) 113 or the second arm member 114. Vector analysis is performed in the states respectively shown in the drawings, in each of which, the state of the keyboard cover 111 is not changed by a hand or finger of a user. Although a detailed description of these states will be given later, for example, the clockwise pivoting force of the second arm member 114 in the state shown in FIG. 18 (FIG. 15) is 180.63 (kg·mm), which is the maximum value.

Although not shown in FIGS. 20 to 27, the values of La, Lb, $\alpha$, and $\beta$ are given as follows.

Note that in the states shown in FIGS. 12 to 14 (FIGS. 20 to 22), since the second arm member 114 is in contact with the stopper 128 and locked, any consideration need not be given to torques about the point B, and the values of Lb and $\beta$ need not be given.

In the state shown in FIG. 12,

La=22.7 and $\alpha$=218°.

In the state shown in FIG. 13,

La=18.1 (mm) and $\alpha$=179°.

In the state shown in FIG. 14,

La=30.3 (mm) and $\alpha$=113°.

In the state shown in FIG. 15,

La=42.9 (mm), $\alpha$=86°, Lb=46.8 (mm), $\beta$=82.5°, L3=52.7 (mm), and L5=20.4 (mm).

In the state shown in FIG. 16,

La=41.1 (mm), $\alpha$=89.7°, Lb=31.1 (mm), $\beta$=62.4°, L3=54.36 (mm), and L5=37.1 (mm).

In the state shown in FIG. 17,

La=34.55 (mm), $\alpha$=102.5°, Lb=26.01 (mm), $\beta$=29.0°, L3=53.74 (mm), and L5=25.98 (mm).

In the state shown in FIG. 18,

La=26.16 (mm), $\alpha$=125.7°, Lb=37.32 (mm), $\beta$=16.7°, L3=51.19 (mm), and L5=3.86 (mm).

In the state shown in FIG. 19,

La=21.0 (mm), $\alpha$=150°, Lb=47.0 (mm), $\beta$=17.0°, L3=52.0 (mm), and L5=6.0 (mm).

Figure 28:
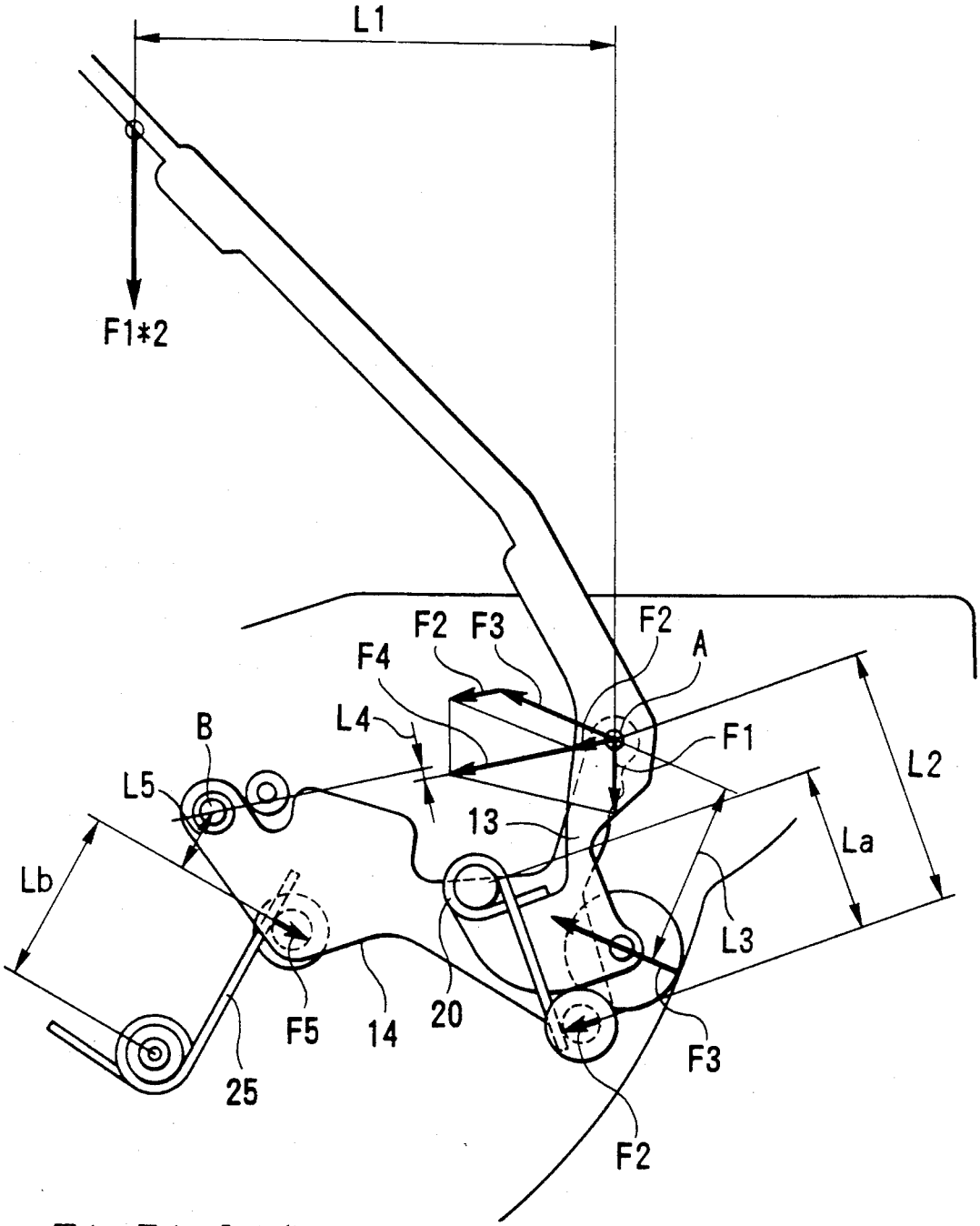
FIG. 28 is a view for explaining vector analysis at a main part in FIG. 15.

By using FIG. 28, the state shown in FIG. 15 is vector-analyzed as a typical example indicating an intermediate step of opening the closed keyboard cover 111. FIG. 28 shows how vectors act at specific portions in the state shown in FIG. 15. The respective reference symbols have the same meanings as those described above. FIG. 28 shows forces acting on points of action around the point A, and F4=F1+F2+F3. The rotational moment T4 based on the resultant force F4 about the point B which the second arm member 114 receives is given by T4=F4×L4. The rotational moment T5 is another force about the point B. The rotational moment T5 is based on the second spring 125 and is given by T5=F5×L5.

The rotational moment T is the sum of T4 and T5. The rotational moment T is a synthetic rotational moment which the second arm member 114 receives, in accordance with the force of the spring, the weight of the cover, and a repulsive force received by the roller. The rotational moment T acts as a force for rotating the member 114 clockwise. If the second arm member 114 is supported with a force corresponding to this rotational moment and acting in the opposite direction (counterclockwise), the keyboard cover 111 is stopped at the corresponding position.

Similarly, rotational moments in the states shown in FIGS. 12 to 14 and FIGS. 16 to 19 can be vector-analyzed by applying the above-described concept.

As is apparent from FIGS. 20 to 27, according to this embodiment, the pivoting force based on the weight of the keyboard cover 111 balances the biasing force (damping force) of the first or second spring 120 or 125 upon an opening/closing operation of the cover 111. Therefore, the keyboard cover 111 can be smoothly opened and closed with a small operating force throughout the process of opening/closing the cover 111.

In addition, as shown in FIGS. 25 to 27, the value of T5 is decreased from −101.3 to −12.47 and −15.36, thus reducing the damping force against the rotational moment acting in a direction to open the keyboard cover 111. This is because a change in the moment T2 about the point A is larger than a change in the repulsive force F2 which the first spring 120 receives. With regard to a reduction in damping effect in a cover closing operation, it is apparent that the value of the moment T2 of the first spring 120 about the point A is reduced from 309 to 199 in the state shown in FIG. 12, that is, the repulsive force is considerably reduced. In this manner, the damping effect is reduced immediately before the keyboard cover 111 is completely closed or opened, so that the pivoting force based on the weight of the cover 111 and acting in the direction to open or close the cover 111 is increased to obtain a sense of complete closing/opening of the cover 111 and stability.

The present invention is not limited to the keyboard cover opening/closing mechanism in the above-described embodiment but may be applied to other pivot keyboard covers using opening/closing mechanisms. In addition, the present invention is not limited to an electronic keyboard instrument but may be applied to other acoustic keyboard instruments such as organs and upright pianos.

It is apparent that the present invention is not limited to a keyboard instrument and can be applied to a mechanism for opening/closing the cover of a structure having an opening portion.

What is claimed is:

1. A keyboard instrument comprising:

an instrument main body having a keyboard portion arranged thereon;

a keyboard cover which pivots about a rear end portion thereof to open/cover said keyboard portion on said instrument main body;

a link member having one end pivotally supported on said instrument main body, and another end pivotally supported on a first position of the rear end portion of said keyboard cover;

a guide abutment portion arranged at a second position, said second position being separated from the first position in a direction of a rear surface of said instrument main body by a predetermined distance; and a guide member fixed in said instrument main body, said guide abutment portion being moved in contact with said guide member upon opening/-closing of said keyboard cover.

2. An instrument according to claim 1, wherein said guide abutment portion is a slide member which slides along said guide member.

3. An instrument according to claim 2, wherein said slide member is a roller which is in rolling contact with said guide member.

4. An instrument according to claim 1, further comprising a press member for pressing said guide abutment portion against said guide member.

5. An instrument according to claim 1, further comprising damping force generating means for generating a damping force for reducing a pivoting force based on a weight of said keyboard cover from a predetermined position between a cover closing position and a cover opening position in at least one direction to the cover opening position and the cover closing position in accordance with an opening/closing operation of said keyboard cover.

6. An instrument according to claim 5, wherein said damping force generating means is a supplementary force generating means for generating a supplementary force biased in a direction to counteract the pivoting force based on the weight of said keyboard cover.

7. An instrument according to claim 5, wherein said damping force generating means generates said damping force act, on said pivoting force in both a cover opening direction toward the cover opening position and a cover closing direction toward the cover closing position from the predetermined position of said keyboard cover, and the damping forces in both the cover opening and cover closing directions become zero at the predetermined position.

8. An instrument according to claim 5, wherein said damping force generating means reduces the damping force during at least one time immediately before said keyboard cover is completely closed or open.

9. An instrument according to claim 5, wherein said damping force generating means comprises a first elastic member for applying a first pivoting force between said instrument main body and said link member, and a second elastic member for applying a second pivoting force between said link member and the rear end portion of said keyboard cover.

10. An instrument according to claim 1, wherein said guide member comprises a first guide surface having a small curvature and a second guide surface having a large curvature, along which said guide abutment portion is continuously moved in pivoting of said keyboard cover between the cover closing position and a predetermined position and between the predetermined position and the cover opening position.

11. An instrument according to claim 1, further comprising a lock member for locking said guide member to an upper limit position corresponding to a closed state of said keyboard cover in pivoting thereof between the cover closing position and a predetermined position.

12. An instrument according to claim 1, wherein said keyboard cover comprises a cover member having a linear cross section in relation to a forward and backward directions of said instrument main body, and a stored portion which is continuous with said cover member and has an arcuated cross section, and at least part of said stored portion is stored in said instrument main body.

13. An instrument according to claim 1, wherein at least part of said keyboard cover is constituted by a transparent member.

14. An instrument according to claim 1, wherein at least part of said keyboard cover is constituted by a translucent member.

15. An instrument according to claim 1, wherein said guide abutment portion is integrally fixed to the rear end portion of said keyboard cover.

16. A keyboard instrument comprising:

an instrument main body having a keyboard portion arranged thereon;

a keyboard cover for opening/covering said keyboard portion on said instrument main body;

a keyboard cover opening/closing mechanism for performing an opening/closing operation of said keyboard cover by causing said keyboard cover to pivot about a rear end portion thereof in relation to said instrument main body, said open/closing mechanism including a guide means for moving said rear end portion in an arc to store the rear end portion in the instrument main body; and damping force generating means for generating a damping force for reducing a pivoting force base on a weight of said keyboard cover from a predetermined position between a cover closing position and a cover opening position in both an opening direction toward the opening position from the predetermined position and a closing direction toward the closing position from the predetermined position in accordance with the opening/-closing operation of said keyboard cover, the damping force in both the opening direction and the closing direction being zero at the predetermined position.

17. A keyboard instrument comprising:

an instrument main body having a keyboard portion arranged thereon;

a keyboard cover for opening/covering said keyboard portion on said instrument main body;

a keyboard cover opening/closing mechanism for performing an opening/closing operation of said keyboard cover by causing said keyboard cover to pivot about a rear end portion thereof in relation to said instrument main body;

an opening formed in a rear surface of said instrument main body to extend in directions to two side surfaces of said instrument main body; and a foreign object removal panel having an inclined surface between a top board of said instrument main body and said keyboard cover opening/closing mechanism, said inclined surface being formed such that an object which falls from a gap formed between said top board and said keyboard cover upon opening/closing said keyboard cover is slid to said opening.

18. A keyboard instrument comprising:

an instrument main body having a keyboard portion arranged thereon;

a keyboard cover for opening/covering said keyboard portion on said instrument main body;

a keyboard cover opening/closing mechanism for performing an opening/closing operation of said keyboard cover by causing said keyboard cover to pivot about a rear end portion thereof in relation to said instrument main body, said open/closing mechanism including a guide means for moving said rear end portion in an arc to store the rear end portion in the instrument main body; and an elastic member for biasing said keyboard cover so as to restrict pivoting movement of said keyboard cover in both a closing direction toward a closing position of said cover and in an opening direction toward an opening position of said cover operation, said elastic member being attached to said keyboard cover opening/closing mechanism so as to reduce the biasing force immediately before said cover reaches said closing position and said opening position.

19. An instrument according to claim 18, wherein said elastic member is supported at a position separated from a pivot center of said keyboard cover so as to be displaceable together with said keyboard cover.

20. A structure having a cover comprising:

a main body having an opening portion in a longitudinal direction;

a cover which pivots about a rear end portion thereof to open/cover said opening portion back and forth on said main body;

a link member having one end pivotally supported on said main body, and another end pivotally supported at a first position of the rear end portion of said cover;

a guide abutment portion arranged at a second position, said second position being separated from the first position in a direction of a rear surface of said main body by a predetermined distance; and a guide member, fixed in said main body, for causing said guide abutment portion to be moved in contact with said guide member upon opening/closing of said cover.

21. A structure comprising:

a main body having an opening portion;

a cover for opening/covering said opening portion on said main body;

a cover opening/closing mechanism for performing an opening/closing operation of said cover by causing said cover to pivot about a rear end portion thereof in relation to said main body, said open/-closing mechanism including a guide means for moving said rear end portion in an arc to store the rear end portion in the main body; and damping force generating means for generating a damping force for reducing a pivoting force based on a weight of said cover from a predetermined position between a cover closing position and a cover opening position both an opening direction toward the opening position from the predetermined position and a closing direction toward the closing position from the predetermined position in accordance with the opening/closing operation of said cover, the damping force in both the opening direction and the closing direction being zero at the predetermined position.

22. A structure comprising:

a main body having an opening portion;

a cover for opening/covering said opening portion on said main body;

a cover opening/closing mechanism for performing an opening/closing operation of said cover by causing said cover to pivot about a rear end portion thereof in relation to said main body, said open/-closing mechanism including a guide means for moving said rear end portion in an arc to store the rear end portion in the main body; and an elastic member for biasing said cover so as to restrict pivoting movement of said cover in both a closing direction toward a closing position of said cover and in an opening direction toward an opening position of said cover due to a weight thereof at a latter stage of the opening/closing operation, said elastic member being attached to said cover opening/closing mechanism so as to reduce the biasing force immediately before said cover reaches said closing position and said opening position.

* * * * *